US009757699B2

(12) United States Patent
Ahmed et al.

(10) Patent No.: US 9,757,699 B2
(45) Date of Patent: Sep. 12, 2017

(54) SPATIOTEMPORAL CONTROL OF CHEMICAL MICROENVIRONMENT USING OSCILLATING MICROSTRUCTURES

(71) Applicant: The Penn State Research Foundation, University Park, PA (US)

(72) Inventors: Daniel Ahmed, State College, PA (US); Stephen Benkovic, State College, PA (US); Tony Jun Huang, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 118 days.

(21) Appl. No.: 14/092,104

(22) Filed: Nov. 27, 2013

(65) Prior Publication Data

US 2014/0146634 A1 May 29, 2014

Related U.S. Application Data

(60) Provisional application No. 61/730,331, filed on Nov. 27, 2012.

(51) Int. Cl.
*B01F 13/00* (2006.01)
*B01F 11/00* (2006.01)
(Continued)

(52) U.S. Cl.
CPC ..... *B01F 13/0059* (2013.01); *B01F 11/02* (2013.01); *B01F 11/0283* (2013.01); *B01F 15/00493* (2013.01); *B01F 15/0404* (2013.01)

(58) Field of Classification Search
CPC ..... B01F 13/0059; B01F 11/0059; B01F 11/0283; B01F 15/0404
(Continued)

(56) References Cited

U.S. PATENT DOCUMENTS 5,633,552 A 5/1997 Lee et al.
6,010,316 A * 1/2000 Haller ..... B01L 3/50273 366/DIG. 4
(Continued)

FOREIGN PATENT DOCUMENTS

EP 2145687 A1 1/2010
RU 2243630 C2 12/2004
(Continued)

OTHER PUBLICATIONS

Ahmed, D. et al., "Chemical Waveform and Switching Via Acoustically Activated Bubbles," Department of Engineering Science and Mechanics, Bioengineering Department, The Pennsylvania University, presented at the 15th International Conference on Miniaturized Systems for Chemistry and Life Sciences, Oct. 2-6, 2011, Seattle, WA.

(Continued)

*Primary Examiner* — Tony G Soohoo
*Assistant Examiner* — Anshu Bhatia
(74) *Attorney, Agent, or Firm* — Dinsmore & Shohl LLP

(57) ABSTRACT

Apparatuses and methods for generating a chemical gradient within a flow channel include providing at least one bubble support structure within the flow channel. A bubble support structure helps maintain a bubble at a predetermined location in flow channel when a fluid flow passes therethrough. Oscillations are induced in the bubble using acoustic waves, which may be provided by a piezoelectric transducer located proximate the flow channel. Two or more inlets provide fluids of different chemical compositions into the flow channel, and bubble oscillations are used to generate a dynamically controllable mixing process.

20 Claims, 17 Drawing Sheets

(51) Int. Cl.

| | |
|---|---|
| ***B01F 11/02*** | (2006.01) |
| ***B01F 15/04*** | (2006.01) |
| ***B01F 15/00*** | (2006.01) |

(58) Field of Classification Search
USPC ..... 366/127, 160.2
See application file for complete search history.

(56) References Cited

U.S. PATENT DOCUMENTS

| | | | | |
|---|---|---|---|---|
| 6,168,948 | B1 | 1/2001 | Anderson et al. | |
| 6,537,498 | B1 | 3/2003 | Lewis et al. | |
| 6,649,069 | B2 * | 11/2003 | DeAngelis ..... | B01F 11/025 366/DIG. 4 |
| 6,669,454 | B2 | 12/2003 | Lal et al. | |
| 7,601,267 | B2 | 10/2009 | Haake et al. | |
| 7,601,287 | B2 | 10/2009 | Adair et al. | |
| 8,573,060 | B2 | 11/2013 | Huang et al. | |
| 2001/0055529 | A1 | 12/2001 | Wixforth | |
| 2004/0066703 | A1 * | 4/2004 | Sparey-Taylor .... | B01F 13/0059 366/127 |
| 2004/0069717 | A1 | 4/2004 | Laurell et al. | |
| 2005/0161326 | A1 | 7/2005 | Morita et al. | |
| 2005/0241935 | A1 | 11/2005 | Lewis et al. | |
| 2006/0024206 | A1 | 2/2006 | Sinha et al. | |
| 2006/0034735 | A1 | 2/2006 | Miura et al. | |
| 2008/0181827 | A1 | 7/2008 | Bassler et al. | |
| 2008/0229831 | A1 | 9/2008 | Serban et al. | |
| 2008/0245745 | A1 | 10/2008 | Ward et al. | |
| 2008/0302732 | A1 | 12/2008 | Soh et al. | |
| 2009/0066936 | A1 | 3/2009 | Huang et al. | |
| 2009/0158823 | A1 | 6/2009 | Kaduchak et al. | |
| 2009/0162887 | A1 | 6/2009 | Kaduchak et al. | |
| 2009/0226994 | A1 | 9/2009 | Lemor et al. | |
| 2010/0124142 | A1 * | 5/2010 | Laugharn, Jr. ..... | B01F 13/0059 366/108 |
| 2010/0139377 | A1 | 6/2010 | Huang et al. | |
| 2010/0200092 | A1 | 8/2010 | Beltram et al. | |
| 2010/0304501 | A1 | 12/2010 | Lee et al. | |
| 2012/0160746 | A1 | 6/2012 | Thorslund et al. | |

FOREIGN PATENT DOCUMENTS

| | | | |
|---|---|---|---|
| RU | 2253888 | C2 | 6/2005 |
| WO | WO-03089158 | A1 | 10/2003 |
| WO | WO-2007128045 | | 11/2007 |
| WO | WO-2007128046 | A1 | 11/2007 |
| WO | WO-2008083138 | A1 | 7/2008 |
| WO | WO-2008118740 | A2 | 10/2008 |

OTHER PUBLICATIONS

International Search Report and Written Opinion dated Mar. 7, 2014 in co-pending application PCT/US2013/072296, filed Nov. 27, 2013.

Nilsson, et al., Acoustic control of suspended particles in micro fluidic chips, Lab on a Chip, 4:131-135, 2004.

Wang, et al., Single-molecule tracing on a fluidic microchip for quantitative detection of low-abundance nucleic acids, Journal of the American Chemical Society, 127:5354-5359, 2005.

Wang, et al., Dielectrophoresis switching with vertical sidewall electrodes for microfluidic flow cytometry, Lab on a Chip, 7:1114-1120, 2007.

Wiklund, et al., Ultrasonic standing wave manipulation technology integrated into dielectrophoretic chip, Lab on a Chip, 6:1537-1544, 2006.

Shi, et al., Focusing microparticles in a microfluidic channel with standing surface acoustic waves (SSAW), Lab on a Chip, 8:221-223, 2008.

Shi, et al., Acoustic tweezers: patterning cells and microparticles using standing surface acoustic waves (SSAW), Lab on a Chip, 9:2890-2895, 2009.

Mao, et al., Focusing fluids and light: enabling technologies for single-particles detection in the micro/nanoscale, IEEE Nanotechnology Magazine, 2:22-27, 2008.

Mao, et al., "Microfluidic drifting"—implementing three-dimensional hydrodynamic focusing with a single-layer planar microfluidic device, Lab on a Chip, 7:1260-1262, 2007.

Mao, et al., Single-layer planar on-chip flow cytometer using microfluidic drifting based three-dimensional (3D) hydrodynamic focusing, Lab on a Chip, 9:1583-1589, 2009.

Wood, C.D. et al., "Alignment of particles in microfluidic systems using standing surface acoustic waves," Applied Physics Letters, 2008, vol. 92, 044104 (Published online Jan. 30, 2008).

* cited by examiner

FIG. 5D
| HSS:A | HSS:B | ROI |
|---|---|---|
| 0 | 0 | |
| 1 | 0 | |
| 0 | 1 | |
*1 : Active*
*0 : Inactive*
FIG. 5E
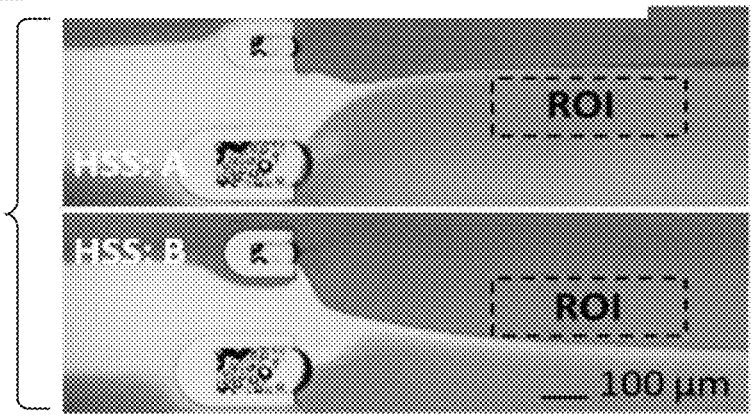
FIG. 5F
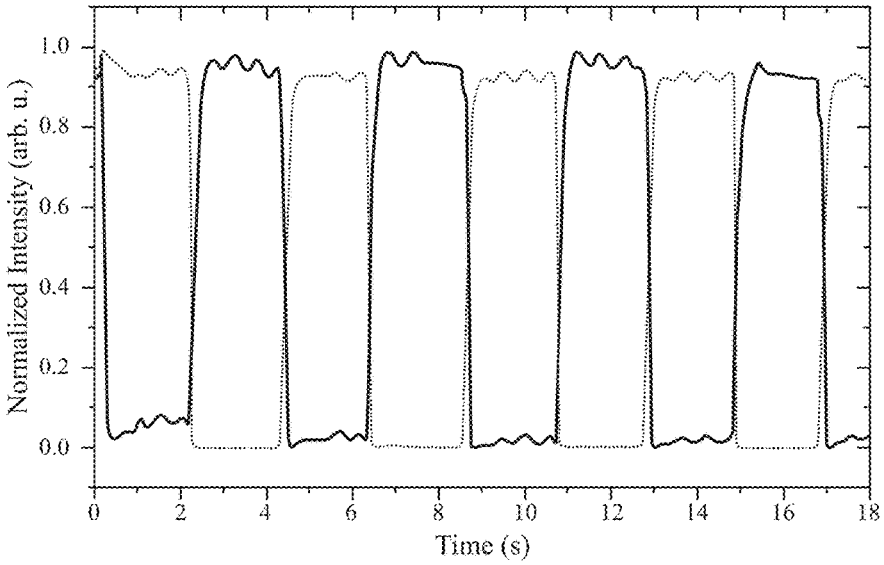

FIG. 8C
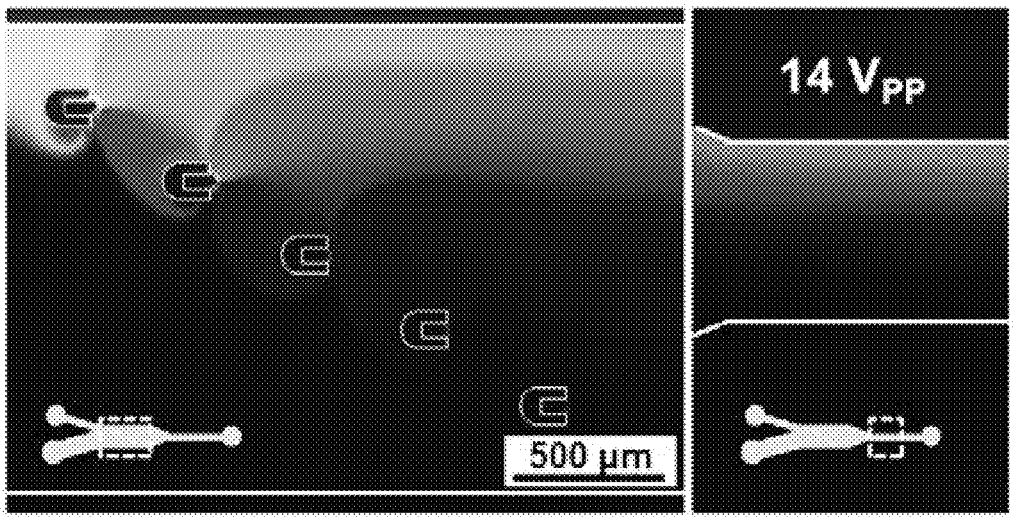
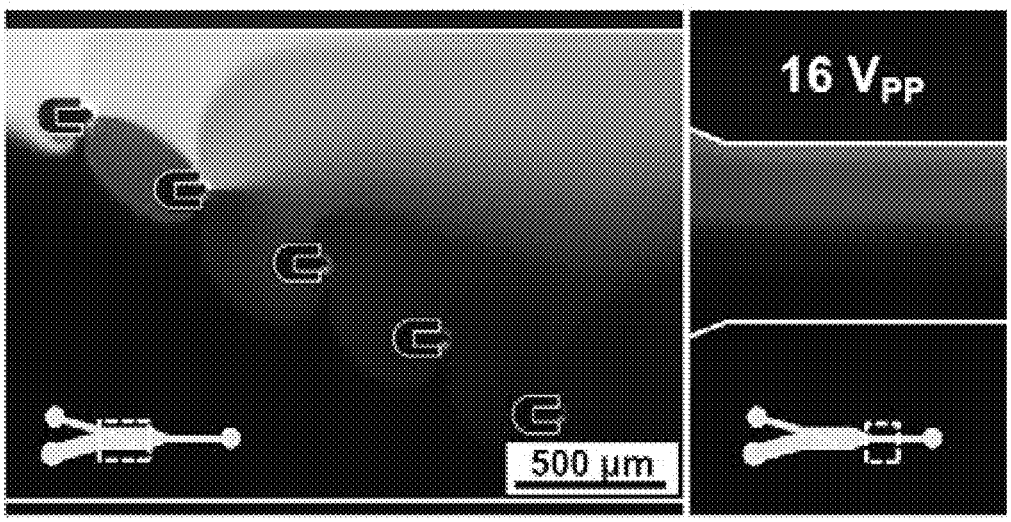
FIG. 8D

SPATIOTEMPORAL CONTROL OF CHEMICAL MICROENVIRONMENT USING OSCILLATING MICROSTRUCTURES

REFERENCE TO RELATED APPLICATIONS

This patent application claims priority from U.S. provisional patent application Ser. No. 61/730,331, filed Nov. 27, 2012, the entire contents of which is incorporated herein in its entirety.

STATEMENT OF GOVERNMENT SUPPORT

This invention was made with government support under Grant No. ECCS0824183, awarded by the National Science Foundation and under Grant No. OD007209, awarded by the National Institutes of Health. The Government has certain rights in the invention.

FIELD OF THE INVENTION

The present invention relates to spatial and/or temporal control of chemical stimuli. More particularly, the invention relates to an apparatus and methods of inducing a temporal chemical waveform in a microfluidic environment that can be used to tightly and accurately control studies of a variety of biological and chemical processes such as cell migration, differentiation, and apoptosis.

BACKGROUND OF THE INVENTION

Studies of biological processes have shown that differing biological outcomes can result from signals with identical chemical composition when the compositions are presented with differencing spatial or temporal characteristics. For example, transient responses to long-lasting changes in environmental, intercellular, and intracellular conditions are observed in many systems. These transient responses can have very different time scales that range from milliseconds to several hours and can also occur across different spatial dimensions. Examples of such transient responses include the adaptation of tumbling probabilities to nutrient levels in bacterial chemotaxis, bacterial flagellar development, somitogenesis, protein expression during embryo development, JAK/STAT immune response pathways, circadian rhythms, and various feed-forward regulatory motifs. Being able to generate representative environments will provide researchers with essential degrees of freedom when studying such dynamic biological processes.

As such, improved apparatuses and methods for generating chemical gradients are highly desirable.

SUMMARY OF THE INVENTION

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

Examples of the invention provide novel apparatuses and methods to control a chemical microenvironment using trapped bubbles oscillating in an acoustic field where the oscillation is used to produce arbitrary temporal waveforms in a flow system such as buffer solutions. Examples of the invention include using an acoustically activated, bubble-based microfluidic system for generating arbitrary temporal chemical waveforms (both digital and analog) by mixing the stimuli and buffer solutions in a time-dependent fashion. This approach permits continuous modulation of the signal characteristics including shape, frequency, amplitude, and duty cycle, with frequencies reaching up to 30 Hz, and in some examples frequencies greater than 30 Hz.

Integrating multiple bubbles of different dimensions into a single microchannel allows the capacity to quickly switch between two distinct chemical stimuli, wherein the waveform of each stimulus can be independently controlled. Furthermore, by trapping bubbles of same dimensions designed in ladder-like arrangements into a single microchannel, both static and pulsatile chemical gradients are achieved. With its advantages in functionality and versatility, the chemical waveform generation and switching methods presented here are powerful tools that may be used in many biological and chemical applications.

An example apparatus for generating a chemical gradient in a fluid flow includes a flow channel having a first inlet configured to introduce a first flow into the flow channel, and a second inlet configured to introduce a second flow into the flow channel. Two or more inlets may provide fluid flows into a first end of the flow channel. The flow channel also has an outlet at the other, downstream end of the flow channel. A bubble support structure is located within the flow channel, configured to support a bubble within the flow channel when fluid flow passes through the flow channel. The support structure may include a wall, the wall having an opening in the downstream portion of the wall. An acoustic transducer is operable to excite the bubble using acoustic waves. Here, acoustic waves are not limited to human audible waves, but may include frequencies in the tens and hundreds of kHz, and also the MHz. Acoustic (vibrational) excitation of the bubble helps induce mixing of the first and second flows, and generates a chemical gradient in the fluid flow. The chemical gradient has a time dependence controllable using the acoustic transducer, in particular through control of the drive signal provided to the transducer. The flow channel may be a microchannel supported by a substrate, defined by the substrate and walls formed optionally in a molded polymer located on the substrate. The apparatus may be a microfluidic device. The acoustic transducer may be a piezoelectric transducer.

A method of generating a chemical gradient in a flow channel includes introducing a first fluid and a second fluid into the channel, supporting a bubble within the channel, and using acoustic waves to drive oscillations in the bubble, the oscillations inducing a mixing process (such as a partial mixing process) between the first fluid and the second fluid, the chemical gradient being formed by the mixing process. The first fluid may be a first liquid, the second fluid may be a second liquid, the channel being a flow channel, the first liquid and the second liquid passing through the flow channel and having different chemical or biological compositions, the oscillations of the bubble within the flow channel creating the chemical gradient.

BRIEF DESCRIPTION OF THE DRAWINGS

FIG. 5D is a table illustrating the concept of binary logic circuitry useful in the apparatus of FIG. 5A;

FIG. 5E illustrates results of switching between the blue (darker shade) and red dyes (lighter shade) in the apparatus of FIG. 5A;

FIG. 5F is a graphical illustration of experimental data for switching between red (dotted line) and blue (solid line) dyes in the selected ROI marked in FIG. 5E using the apparatus of FIG. 5A;

FIG. 8C illustrates the concentration gradient profile produced in the apparatus of FIG. 6A generated when the applied voltage is 14 $V_{pp}$;

FIG. 8D illustrates the concentration gradient profile produced in the apparatus of FIG. 6A generated when the applied voltage is 16 $V_{pp}$;

DETAILED DESCRIPTION OF EMBODIMENTS OF THE INVENTION

Figure 1A:
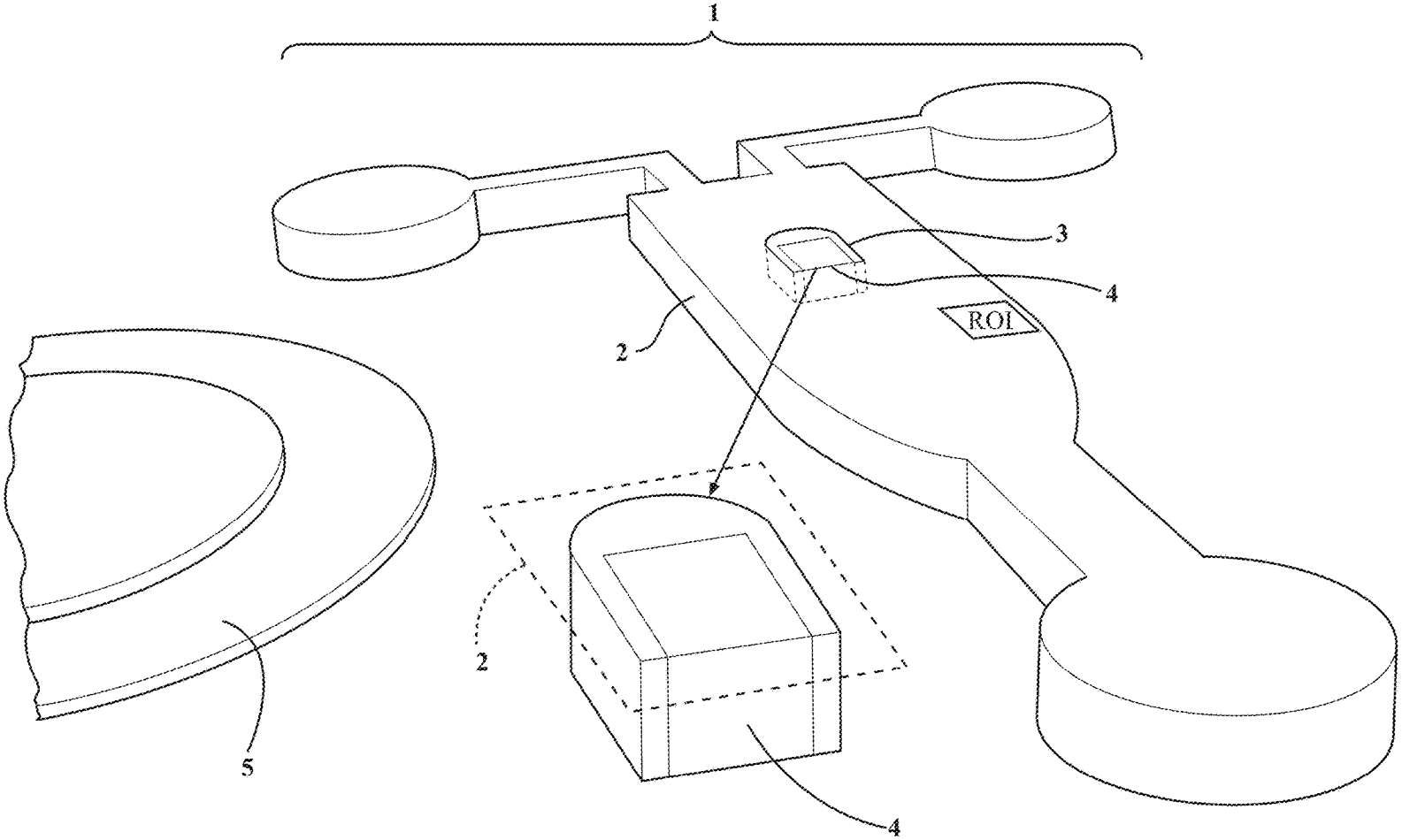
FIG. 1A is a schematic of an apparatus according to one embodiment of the invention where the piezoelectric transducer, which generates low-intensity acoustic waves, is placed adjacent to the microfluidic channel on a glass slide, and in which acoustic waves generated by the transducer drive the bubble trapped in the support structure in the form of a horse-shoe (HSS) placed at the interface of the co-flowing liquids.

The following description of particular embodiment(s) is merely exemplary in nature and is in no way intended to limit the scope of the invention, its application, or uses, which may, of course, vary. The invention is described with relation to the non-limiting definitions and terminology included herein. These definitions and terminology are not designed to function as a limitation on the scope or practice of the invention but are presented for illustrative and descriptive purposes only. Examples of the present invention include methods and apparatuses using one or more oscillating structure(s) driven by an oscillatory energy field (optionally acoustic) to provide a unique and versatile method to generate prescribed temporal chemical gradient waveforms by mixing two or more fluids, such as first and second liquid flows (e.g. stimulus and buffer solutions), optionally in a time-dependent manner. This approach is capable of generating not only digital chemical waveforms, but also analog waveforms whose characteristics, including shape, frequency, amplitude, and duty cycle, can be modulated by controlling the oscillation of one or more oscillating structures within a flow channel.

In some embodiments, trapping multiple oscillating structures in a single microchannel allows for switching between two or more distinct stimuli wherein the waveform of each stimulus can be independently controlled. Supporting (e.g. trapping) multiple oscillating structures in a single channel (e.g. microfluidic chip) allows integration of a chemical waveform generator and switch with other on-chip functions such as cell/particle manipulation, mixing, separation and/or sorting, and pumping, thus reducing dependencies on off-chip devices.

As such, an apparatus for generating a chemical gradient in a fluid flow is provided. As used herein the word "chemical" is understood to include both chemical and biological such as in the case of cells or other multichemical living or non-living system. An apparatus includes a flow channel, the flow channel including a first inlet configured to introduce a first fluid flow into the flow channel, and a second inlet configured to introduce a second fluid flow into the flow channel. The flow channel also includes an outlet where one or more fluids in either a mixed or non-mixed state may be discharged from the flow channel. An apparatus also includes a support structure located within the flow channel, the support structure supporting an oscillating structure within the flow channel when the first and second flows are introduced into the flow channel. In communication with the oscillating structure is an oscillatory energy field generator operable to produce oscillation in the oscillating structure. The oscillation of the oscillating structure induces mixing of the first and the second fluid flows generating a chemical gradient having a time-dependence controllable using the oscillatory energy field generator. The result is a mixing at the chemical level of the first fluid and the second fluid where the parameters of the mixing are controlled or controllable by the energy field produced by the energy field generator. The result of the inventive apparatus is the ability to tightly control all parameters of the mixing of one or more fluids within the flow channel thereby allowing the creation of gradients tuned for a desired concentration, time, or area in the flow.

An apparatus includes a flow channel. A flow channel is an area capable of containing a flowing fluid. A flow channel is optionally formed of transparent or opaque material. In many embodiments, a flow channel is located on a substrate. The substrate is optionally formed of the same of different material as the flow channel. The flow channel is optionally formed from a solid material. A flow channel is optionally formed from polymer such as polydimethylsiloxane (PDMS), polypropylene (PP), polyethylene terephthalate (PET), polybutylene terephthalate (PBT), polycarbonates (PC), polyethylene (PE), polylactic acid (PLA), nylon, PET copolymers, acrylics, Surlyn™, polyethylene naphthalate (PEN), polyamides, polycarbonate co-polymers, elastomeric polymers-thermoplastic elastomers, thermoplastic urethanes, poly urethanes, acrylic co-polymers, acrylonitrile butadiene styrene, or other thermoplastics, glass such as borosilicate glass or other glass material, quartz, steel optionally stainless steel, gold, combinations thereof, or other material known in the art and suitable for such a purpose. A flow channel optionally has a surface roughness that is sufficiently smooth to allow laminar flow of the fluid moving within the flow channel.

A flow channel is configured to allow a laminar flow of one or more fluids within the flow channel. The flow channel(s) optionally has a cross-sectional shape that is circular, oval, rectangular, square, trapezoidal, triangular, irregular, or other shape. Optionally, the shape of the flow channel varies with linear distance along the flow direction of the fluid. A flow channel has length longitudinal to the fluid flow that is optionally linear or generally linear, curved, angled, irregular or other desired shape. An exemplary cross-sectional dimension of a flow channel is in the range of 1 μm to 30 mm or greater, or any value or range therebetween. A cross-sectional dimension of a flow channel is optionally 1 μm to 10 mm, optionally 1 μm to 1 mm, optionally 10 μm to 1 mm, optionally 100 μm to 500μ. The cross-sectional dimension is optionally configured to correspond to the type of fluid passing through the flow channel taking into account considerations of viscosity, chemical or biological content, or other necessary parameters.

A flow channel includes one or more inlets and one or more outlets. An inlet represents an opening through which a fluid may pass to enter the flow channel or portion thereof. An outlet is an opening through which a fluid may pass to exit the flow channel or portion thereof. In a simplified, non-limiting embodiment, two inlets are present and one outlet is present. Typically, the number of inlets corresponds to the number of differing fluids to pass into the flow channel during operation of the apparatus. In some embodiments, the outlet is of larger cross sectional dimension that an inlet or other portion of the flow channel.

A flow channel is optionally a microchannel. A microchannel is a flow channel with a cross-sectional dimension on the order of micrometers or less. A flow channel optionally has one side or edge defined by the substrate material. A flow channel optionally has a width and length parallel to the plane of a substrate. A flow channel also has a height that extends in a direction perpendicular (i.e. normal) to a substrate. The height of a flow channel is optionally from 1 μm to 10 mm or greater. A height of a flow channel is optionally 1 μm to 1 mm, optionally 5 μm to 1 mm, optionally 10 μm to 1 mm, optionally 100 μm to 500 μm. A width of a flow channel in a direction parallel to a substrate surface or perpendicular to a fluid flow direction is any width suitable for containing the number of fluids to be flowed through the channel.

A flow channel contains a fluid. Optionally, a flow channel surrounds a fluid. A fluid is optionally a liquid at testing temperatures and pressures. A fluid is optionally a biologically compatible media such as water or buffered liquid illustratively including phosphate, tris(hydroxymethyl)aminomethane (tris), citrate, 4-(2-hydroxyethyl)-1-piperazineethanesulfonic acid (HEPES), or other buffering system. A fluid is optionally water, saline, an organic liquid, or other desired flowable material. A fluid is optionally a gel. A fluid is optionally a suspension of one or more types of suspended particles, cells or other substance. A fluid optionally contains one or more test substances. A test substance is any chemical or biological material that is desired for testing. A fluid has a test substance concentration. Optionally, a first fluid and a second fluid contain the same or different test substances or concentrations depending on the desired outcome of the system. Optionally, a first fluid and a second fluid are different types of fluids illustratively but not limited to an organic and an aqueous fluid respectively, or vice versa. The fluid type in many embodiments is non-limiting other than the fluid is capable of moving through the flow channel.

A flow channel is optionally presented on a substrate either by the substrate being adjacent to the flow channel or integrated with the flow channel as an edge or wall portion. A substrate is any material of suitable shape and dimension to support a flow channel, and optionally any structure located within the flow channel. A substrate is optionally suitable to conduct or transfer energy from an oscillatory energy field generator so as to transfer the energy to the oscillating structure thereby providing the desired oscillation of the oscillating structure. A substrate is optionally made form a polymeric material, illustratively polypropylene (PP), polyethylene terephthalate (PET), polybutylene terephthalate (PBT), polycarbonates (PC), polyethylene (PE), polylactic acid (PLA), nylon, PET copolymers, acrylics, Surlyn™, polyethylene naphthalate (PEN), polyamides, polycarbonate co-polymers, elastomeric polymers-thermoplastic elastomers, thermoplastic urethanes, poly urethanes, acrylic co-polymers, acrylonitrile butadiene styrene, or other thermoplastics, glass such as borosilicate glass or other glass material, quartz, steel optionally stainless steel, gold, combinations thereof, or other material known in the art and suitable for such a purpose.

Within a flow channel is a support structure. The support structure supports an oscillating structure physically, electrically, magnetically, or by other method. A support structure is optionally integral with a wall of a flow channel, a substrate, or both, and extending therefrom to define an enclosed or partially enclosed region that is capable of housing or defining an oscillating structure. A support structure is optionally in the shape of a C-shape, U-shape, or a horseshoe shape. The horseshoe shape is exemplified herein, but is to be understood as an example only and tailored to the particular oscillating structure supported by the support structure. It is appreciated that other shapes are similarly suitable. Optionally, a support structure has a curved outer wall where outer is defined as oriented toward a fluid relative to the position of an oscillating structure. A support structure optionally has a curved inner wall. A support structure has an orientation. An orientation is optionally defined by an opening or other asymmetric or discontinuous structural characteristic of the support structure. An opening is optionally present opposite or contiguous with a curved outer wall. Optionally, a solid outer wall is oriented in the flow direction toward the direction from which the fluid is flowing. An opening, when present, it optionally oriented at an angle of 90 degrees to 270 degrees from the direction from which fluid is flowing. Optionally, an opening is facing the outlet of the flow channel. Optionally, an opening is facing away from the direction of flow or at a direction of 180 degrees from the direction from which fluid flows in the flow channel. A support structure optionally has an outer dimension of 5 μm to 1000 μm and an inner space of cross sectional dimension of 1 μm to 900 μm.

An apparatus includes an oscillating structure supported or defined by the support structure and optionally by a flow channel wall, the substrate, or combinations thereof. An oscillating structure is a structure that is capable of oscillation, but does not need to be oscillating at all times. Oscillation is defined as movement about a central parameter such as movement side to side or other direction, by movement due to flexing of an outer dimension of an oscillating structure, or by other recognized oscillatory movement. Illustrative non-limiting examples of an oscillating structure include a bubble, microsphere, micelle, solid particle, solid particle containing a flexible oscillating coating, or other structure capable of oscillation. The oscillating structure used in the exemplary embodiments herein are bubbles, but are such for exemplary purposes alone. In embodiments where an oscillating structure is a bubble, the bubble is optionally formed only when fluid is flowed through the flow channel and contains the gas or liquid present in the flow channel prior to the introduction of flow. In such an instance, the semi-enclosed nature of the support structure prevents inflow of the fluid thereby forming the bubble. Optionally, a bubble is introduced by injection of a gas or dissimilar liquid into a support structure during or prior to fluid flow.

An apparatus includes an oscillatory energy field generator operable to produce oscillation in the oscillating structure. An oscillatory energy field generator is any device capable of producing energy that will impart oscillation in an oscillating particle. Energy is optionally acoustic, electrical, optical, magnetic, or other energy. Devices capable of generating such energies are known in the art. The exemplary embodiments herein describe an acoustic energy generator that creates acoustic energy that is felt or received by the oscillating particle causing oscillation in the oscillating particle when the energy is of the correct parameters to produce such oscillation. It is appreciated that acoustic energy and acoustic energy generators are presented herein for exemplary purposes alone and not as a limitation on the present invention. An oscillatory energy field generator is optionally a piezoelectric transducer. Acoustic-based oscillating structure manipulation methods are excellent alternatives to conventional methods. Compared to their optical, electrical, or magnetic counterparts, acoustic-based methods are relatively non-invasive to biological objects and work for most microparticles regardless of their optical, electrical, or magnetic properties.

An oscillatory energy field generator is optionally a chirp interdigital transducer (IDT) or other acoustic energy generating device. An oscillatory energy field generator is formed or attached to the substrate and when energized by an input signal creates a vibration in the substrate. This vibration passes into the oscillating structure directly or indirectly via an intermediate structure to produce oscillation in the oscillating structure. An electronic control circuit is wired to the oscillatory energy field generator to produce the input signal thereby producing the energy field. This circuit may take a variety of forms as is known in the art.

The energy field produces an oscillation of the oscillating structure that is in physical contact with one or more fluids in the flow channel. The oscillation of the oscillating structure induces a mixing of the first and second fluid flows to generate a chemical gradient between the two fluids. This chemical gradient has a time-dependence, spatial dependence, concentration dependence, or composition dependence controllable by the oscillatory energy field generator.

An apparatus according to some embodiments of the invention is a chemical waveform generator using acoustically activated bubbles. A chemical waveform generator 1 was fabricated substantially according to the schematic of FIG. 1A. A single-layer polydimethylsiloxane (PDMS) microchannel was fabricated using the soft lithography and the mold replica technique. A silicon mold for the microchannel was patterned in photoresist (Shipley 1827, MicroChem, Newton, Mass.) and etched with Deep Reactive Ion Etching (DRIE, Adixen, Hingham, Mass.). The mold was then coated with 1H,1H,2H,2H-perfluorooctyl-trichlorosilane (Sigma Aldrich, St. Louis, Mo.) to reduce its surface energy and any subsequent damage to the PDMS channel during the demolding process. Sylgard™ 184 Silicone Elastomer Base and Sylgard™ 184 Silicone Elastomer Curing Agent (Dow Corning, Midland, Mich.) were mixed at a 10:1 weight ratio and cast onto the silicon mold. The uncured PDMS on the silicon mold was then degassed in a vacuum chamber for 2 h to remove any air bubbles and later cured at 65° C. for 45 min. After removing the cured PDMS from the mold, the inlets and the outlets were drilled into the PDMS using a silicon carbide drill bit (model 220/395, Dremel). The microfluidic flow channel was then bonded to a micro cover glass used as a substrate that had been pre-treated with oxygen plasma. A piezoelectric transducer (model no. 273-073, RadioShack) was then attached to the glass slide adjacent to the flow channel using epoxy (Permatex 84101).

Figure 1B:
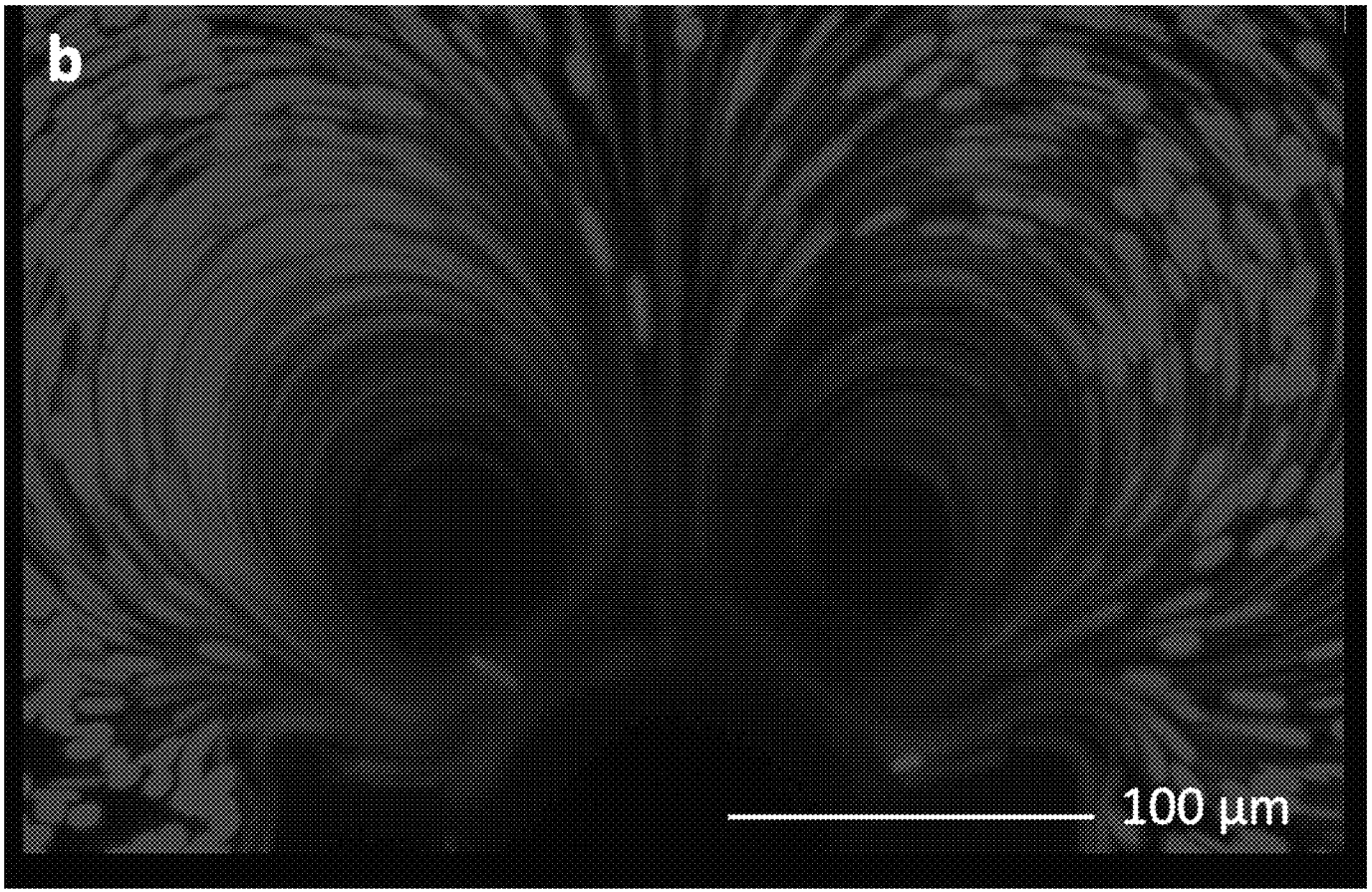
FIG. 1B is an experimental observation of acoustic microstreaming and flow recirculation during the bubble oscillation in the apparatus of FIG. 1A.
Figures 1C, 1D, 1E, 1F, 1G, 1H, 1I:
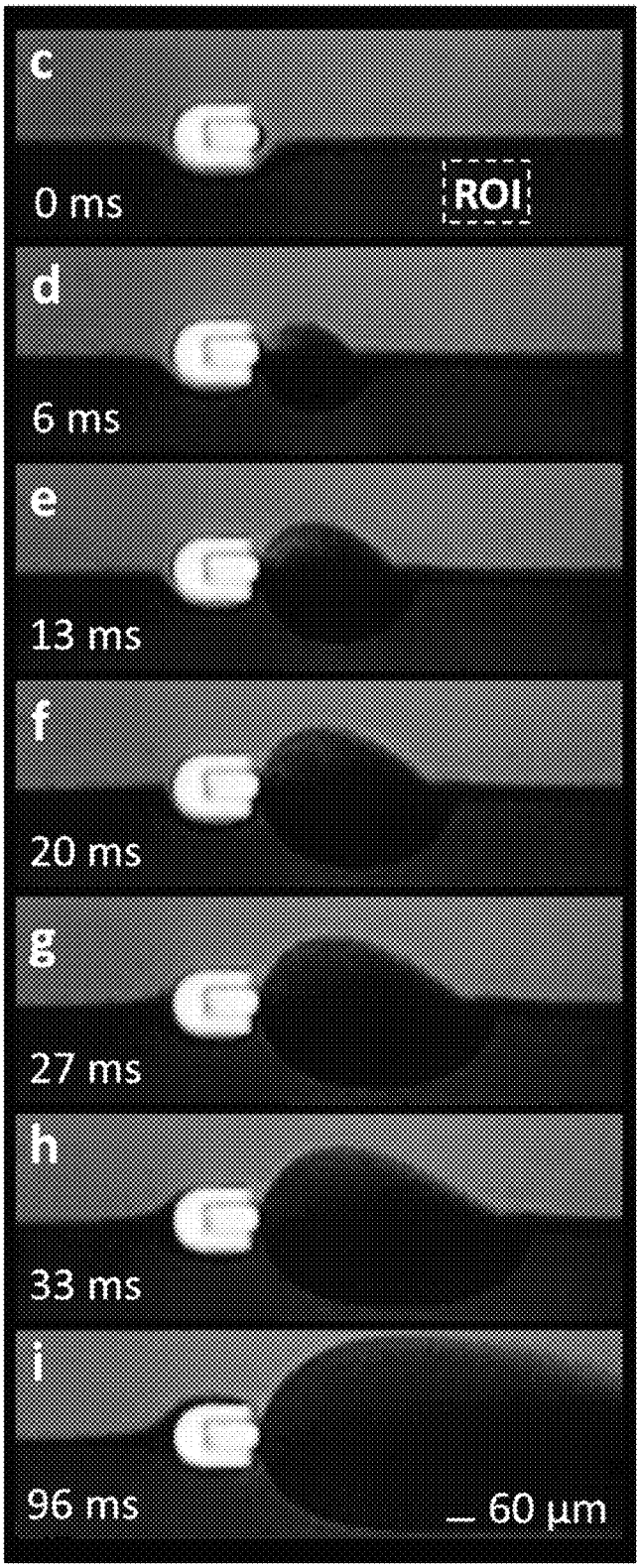
FIG. 1C illustrates experimental observations of acoustic microstreaming and flow recirculation during bubble oscillation in a region of interest (ROI) for the output waveform ~300 μm downstream of the HSS (i.e., past the recirculation zone) at time zero where mixing of the dyes was captured with high-speed imaging.
FIG. 1D illustrates experimental observations of acoustic microstreaming and flow recirculation during bubble oscillation in the ROI for the output waveform ~300 μm downstream of the HSS at time 6 ms where mixing of the dyes was captured with high-speed imaging.
FIG. 1E illustrates experimental observations of acoustic microstreaming and flow recirculation during bubble oscillation in the ROI for the output waveform ~300 μm downstream of the HSS at time 13 ms where mixing of the dyes was captured with high-speed imaging.
FIG. 1F illustrates experimental observations of acoustic microstreaming and flow recirculation during bubble oscillation in the ROI for the output waveform ~300 downstream of the HSS at time 20 ms where mixing of the dyes was captured with high-speed imaging.
FIG. 1G illustrates experimental observations of acoustic microstreaming and flow recirculation during bubble oscillation in the ROI for the output waveform ~300 μm downstream of the HSS at time 27 ms where mixing of the dyes was captured with high-speed imaging.
FIG. 1H illustrates experimental observations of acoustic microstreaming and flow recirculation during bubble oscillation in the ROI for the output waveform ~300 μm downstream of the HSS at time 33 ms where mixing of the dyes was captured with high-speed imaging.
FIG. 1I illustrates experimental observations of acoustic microstreaming and flow recirculation during bubble oscillation in the ROI for the output waveform ~300 μm downstream of the HSS at time 96 ms where mixing of the dyes was captured with high-speed imaging

A horse-shoe structure (HSS) serving as the support structure 2 is located inside the microfluidic channel 3, optionally constructed from polydimethylsiloxane (PDMS). The HSS uses surface tension to trap and support a single bubble 4 that serves as an oscillating structure. The HSS also helps determine the size of the bubble with a larger HSS supporting a relatively larger bubble and a smaller HSS supporting a relatively smaller bubble. When driven by an adjacent piezoelectric transducer 5, the membrane of the trapped bubble oscillates. Like the vibration of strings or the oscillations of a spring-mass system, each bubble has a size-dependent resonance frequency that results in maximum oscillation amplitude. At the resonance frequency frictional forces develop at the interface of the bubble and the surrounding medium giving rise to a pressure gradient in the fluid that results in the prominent recirculating flow regions substantially as depicted in FIG. 1B. This phenomenon is commonly referred to as acoustic "microstreaming" (32, 41-44).

In an exemplary inventive apparatus, when the trapped bubble is excited the counter-rotating vortices developed during microstreaming disrupt the clean liquid-liquid interfaces that are characteristic of the laminar flow regime in the microchannel. The vortices drastically enhance the mass transport along the direction perpendicular to the flow effectively mixing the fluid solutions (on state). The mixing process was observed through fast imaging (1200 frames/s), as shown in FIGS. 1C-1I. Complete mixing of the fluids occurred in less than 30 ms. When the excitation was removed, the mixing stopped and the characteristic laminar flow returned (off state) within about 200 ms. The rate of change from an on state to an off state is dependent on the fluid flow rate, size of the channel, and size of the support structure, among other considerations. The fast responses of the electric and acoustic systems allow the device to directly convert electrical signals into chemical waveforms—effectively implementing all the capacities of a function generator.

Generation of digital chemical waveforms is also possible using the inventive apparatuses. To demonstrate the apparatus' functionality, a variety of different chemical waveforms (FIGS. 2A, 2B, 2D, and 2E) were generated using the transducer control element in the apparatus as depicted in FIG. 1A to control the acoustic excitation. In the experiments, the two inlets were infused with dye and a buffer solution at identical flow rates (6 μl/min). The glass slide including the microfluidic channel and the piezoelectric transducer, was mounted on a Nikon TE-2000U optical microscope stage. Ink (PAR3001100, Parker) or food dye (Assorted/NEON, McCormick) was infused into the channel through a 1 ml syringe (Becton Dickinson) by automated syringe pumps (KDS Legato 210, KD scientific, Holliston, Mass., USA). Once the bubbles were stably trapped with a smooth flow, the transducer was connected to a function generator to control the bubble activation/deactivation via a function generator (Hp8116A/Tektronix AFG 3011). The driving voltages used in the experiments were 8-16 $V_{PP}$.

Data acquisition for the waveform generation in FIG. 2A-E was directly achieved by region of interest (ROI) selection during the experiment using InVivo (MediaCybernatics) microscopy software, connected to a CoolSnap HQ2 (Photometrics) CCD camera. The images in FIG. 1C-I were captured at 1200 fps (to record the fast dynamics of each stimulus) and later processed through a Matlab code. The rest of the images were captured by Nikon D3S or Coolsnap CCD cameras. In some cases, the dynamic properties were captured using videos obtained using a Nikon D3S or Casio EX-F1. Raw video files were encoded into stack of images, and further processed using Image J software (National Institutes of Health, Bethesda, Md.). The optical density of a specified ROI was used to determine the mixing efficiency and give a rough estimate of the stimulant concentration. A square waveform was generated by simply switching the transducer on and off. The frequency (FIG. 2A) and duty cycle (FIG. 2D) of the signals were controlled by appropriately timing the on and off states of the bubble oscillation. Burst/pulse signals were generated (FIG. 2B) by lowering the transducer excitation duration to less than the complete mixing time (30 ms). The frequency of the chemical signal can be modulated without interruption (FIG. 2E), allowing a continuous frequency sweep to be used.

Generation of analog chemical waveforms was also demonstrated using the inventive apparatuses. FIGS. 2A, 2B, 2D, and 2E show several chemical waveforms with constant maximum and minimum amplitudes, i.e., digital waveforms.

To generate analog signals, such as sinusoidal or triangular waveforms, the amplitude of the stimulus (i.e., the concentration of the stimulus) is dynamically varied. This amplitude modulation is achieved by continuously mixing the stimulus and buffer solutions while changing the relative flow rates of the inlets. As the relative flow rates change between two fluids in a microchannel, the location of their interface shifts along the width of the channel due to the difference in inlet pressures. This controllable interface can be used to vary the proportion of each fluid that is mixed by the oscillating structure resulting in a tunable output concentration of the stimulus.

Figure 2A:
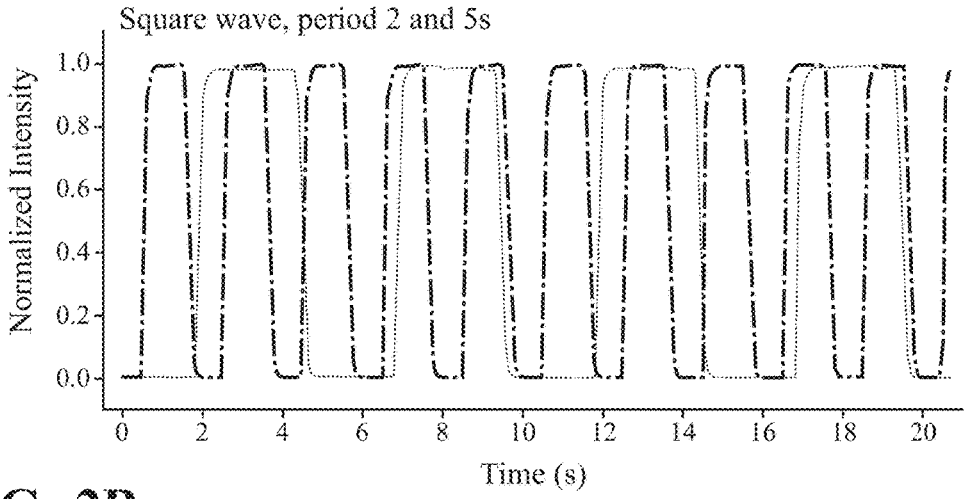
FIG. 2A shows generation of a square wave with a period of 2 seconds or 5 seconds using the apparatus of FIG. 1.
Figure 2B:
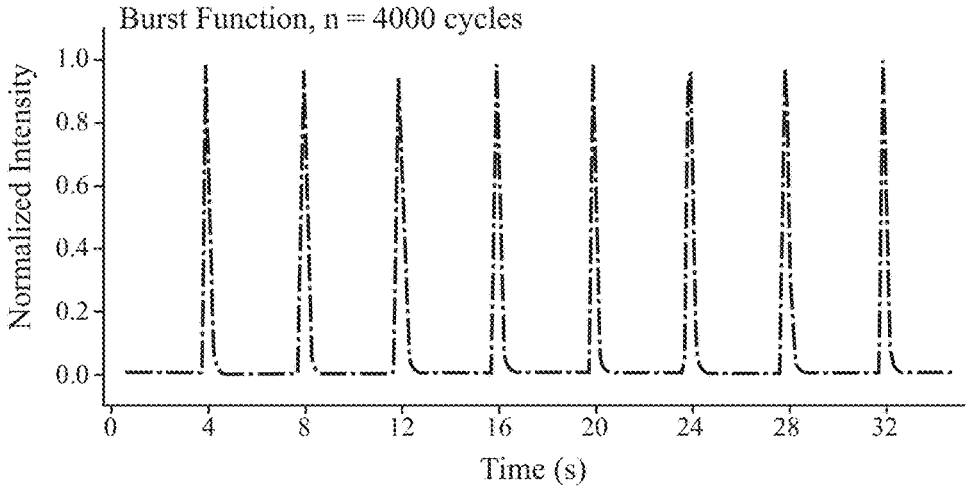
FIG. 2B shows generation of a wave using burst mode by the apparatus of FIG. 1.
Figure 2C:
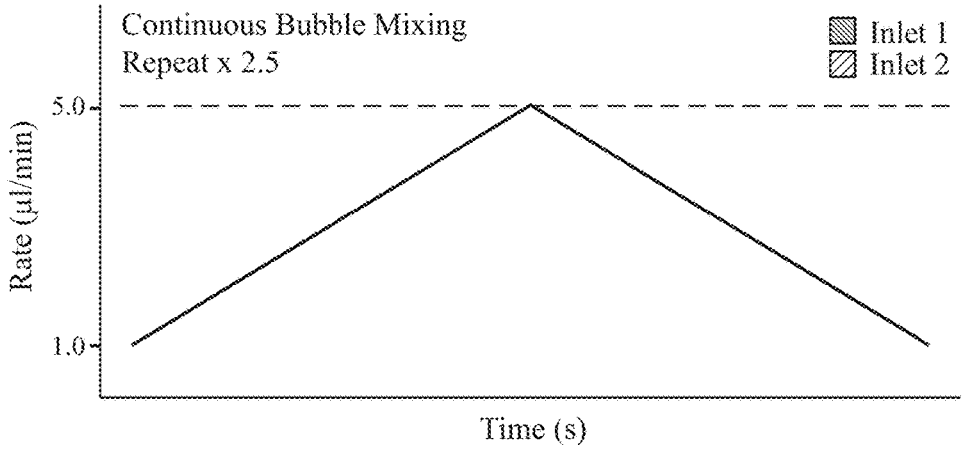
FIG. 2C is a graphical illustration of flow rate utilized in achieving amplitude modulation using the apparatus of FIG. 1.
Figure 2D:
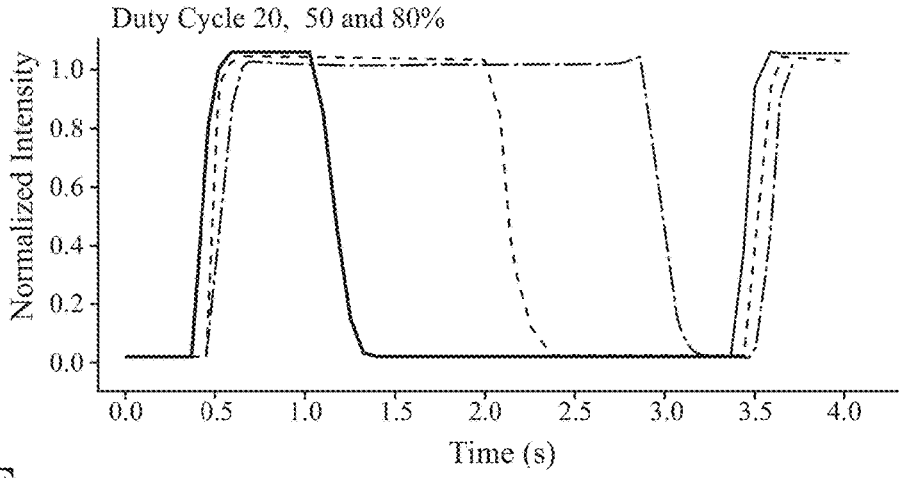
FIG. 2D illustrates various duty cycles using the apparatus of FIG. 1 with a duty cycle of 20% (solid line), 50% (dotted line), and 80% (dot-dash line)
Figure 2E:
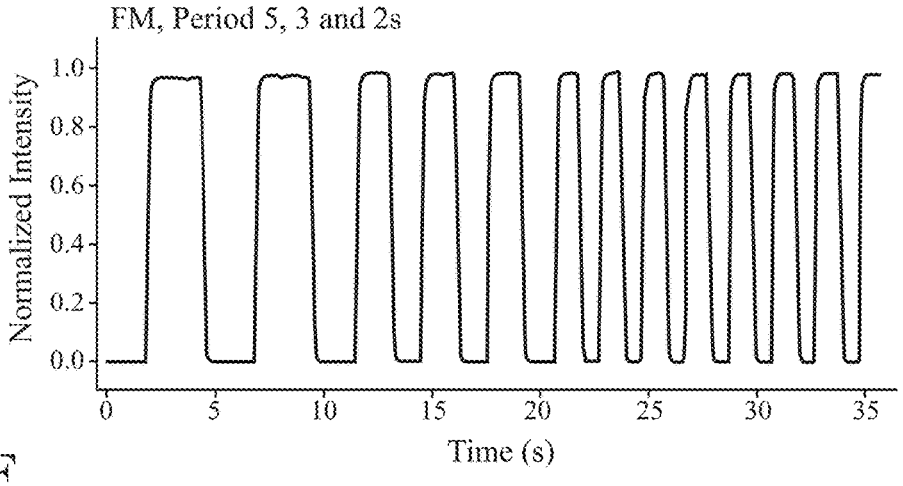
FIG. 2E shows a tunable frequency using the apparatus of FIG. 1.
Figure 2F:
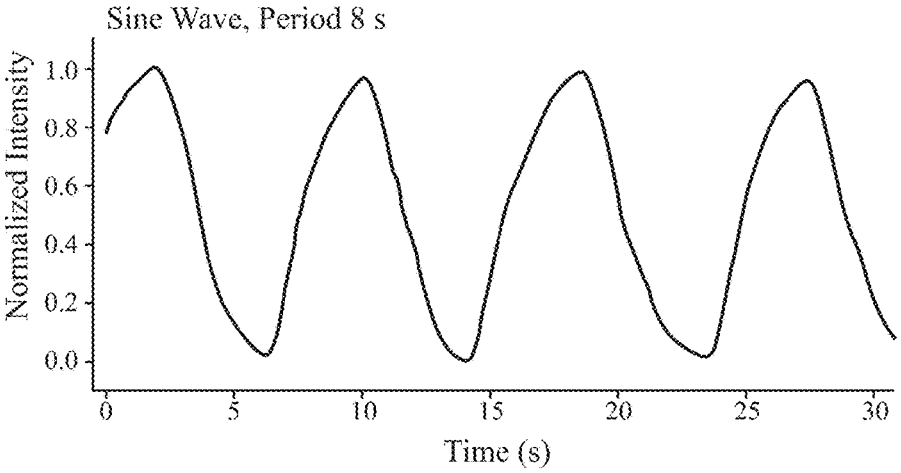
FIG. 2F illustrates a sine wave response generated by the apparatus of FIG. 1.

The applied flow rate pattern and the respective chemical waveform are shown in FIG. 2C and FIG. 2F, respectively. We note, however, that the amplitude modulation frequency will be limited by the response of the flow pump. Combining this bubble-based mixing method with a higher-speed, frequency-specific flow control mechanism is expected to achieve more rapid amplitude modulation that is well suited for high-frequency analog waveforms. Even without the high-speed flow control, this concept can be readily used for applications such as single-shot chemical kinetics studies.

Figure 3:
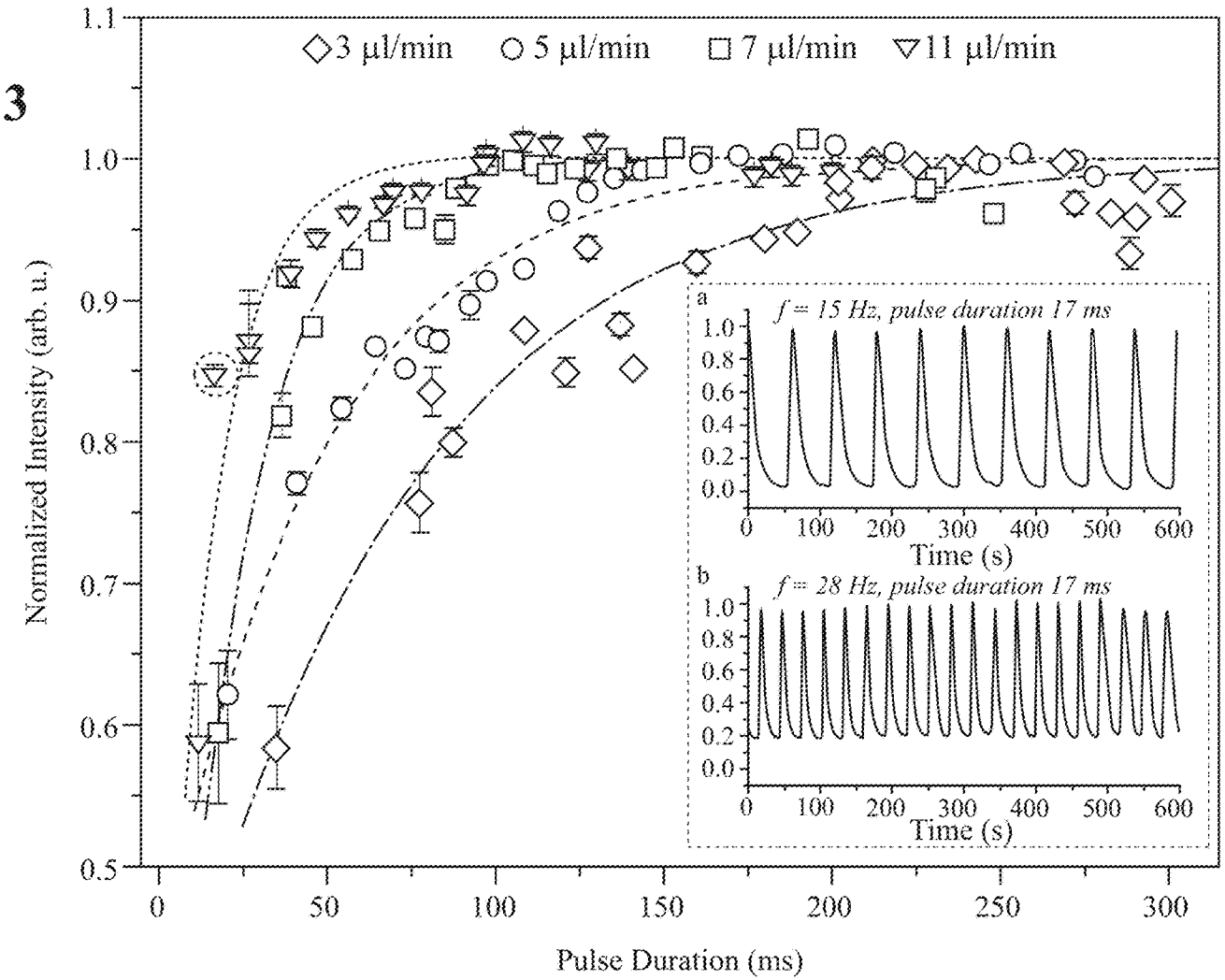
FIG. 3 shows a frequency response of waveform generation with flow rates of 3, 5, 7, and 11 μl/min using the apparatus of FIG. 1, with the insets illustrating waveform generation utilizing the 17 ms pulse duration (marked as dotted circle in parent figure) at 11 μl/min flow rate (a) and 28 Hz for 30 ms trigger interval (b)

High-frequency characterization was achieved using the inventive apparatuses. The digital frequency response is intrinsically limited by the mixing capabilities of the oscillating structure, properties of the fluids (e.g., density and surface tension), flow velocity, and location of the ROI. To quantify the high-frequency response of the device, the photointensity of the ROI during partial mixing (pulse width less than the total mixing time) was compared to the intensity at complete mixing to obtain a quantitative measure of the total mixing efficiency. FIG. 3 shows the relative intensity, indicative of mixing efficiency, at increasing pulse width duration for four different flow rates. The observed response is typical of a low-pass filter where low frequencies show distinct chemical signals but higher frequencies blur into a continuum. As seen in the inset of FIG. 3, the demixing time (i.e., the falling time), which is dependent on the flow rate, is the rate-limiting factor in the device's frequency response. Despite partial mixing, distinct chemical pulses can be generated at frequencies greater than 30 Hz—more than an order of magnitude faster than any previous design (~1 Hz).

Figure 4A:
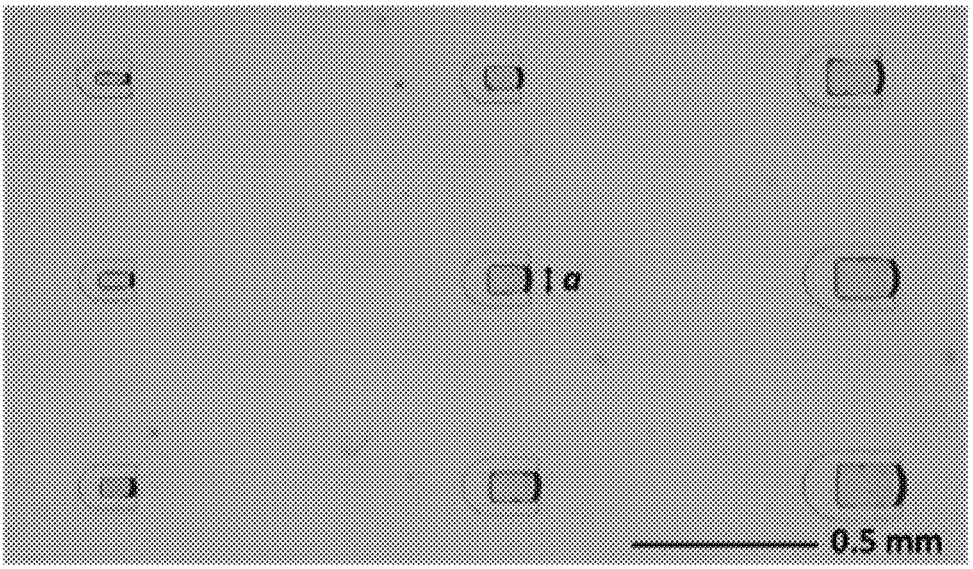
FIG. 4A illustrates characterization of bubbles' resonance frequencies in a 3×3 array of support structures with different dimensions used to obtain different sized bubbles.
Figure 4B:
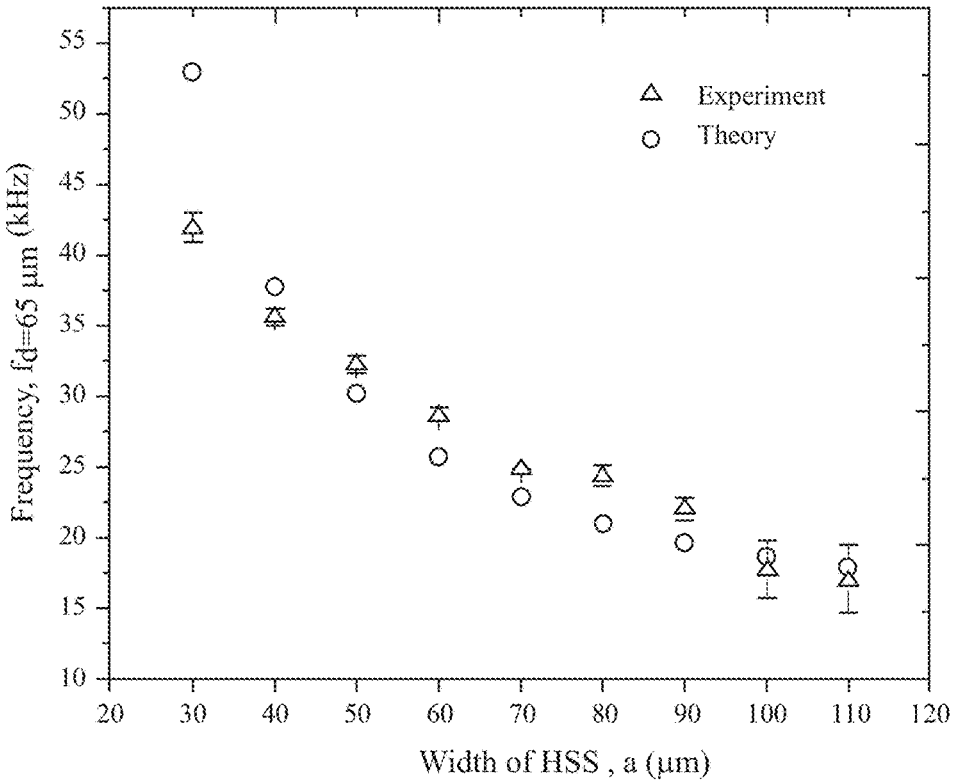
FIG. 4B illustrates both the experimental (triangles) and theoretical (circles) results for resonance frequencies of different-sized bubbles with the error bars representing the standard deviation from three measurements conducted from three different microfluidic chips with depths of 65 μm.

Chemical switching using multiple oscillating structure containing support structures was also demonstrated. While the generation of single chemical waveform is vital to a variety of biochemical studies, dynamically switching between or concurrently applying different chemical stimuli is also important when studying more complex dynamic systems such as cell signaling pathways or cascades of biochemical reactions. In principle, these studies require logic-type control utilizing multiple waveform generators. Independently mixing multiple waveforms within a microchannel requires multiple trapped oscillating structures with different resonance frequencies so they may be excited separately. The resonance frequency of a bubble, for example, is governed by its geometry (i.e., radius) and the properties of the liquid. Assuming a constant liquid medium, the HSS geometry/configuration was used to effectively alter the fundamental resonance frequency of the bubbles. Preventing cross-excitation due to higher-order harmonic modes of oscillation was the main challenge. As an example, nine HSS geometries that varied in width were pre-screened (FIG. 4A). To experimentally determine the resonance frequency of each bubble, the excitation frequency was swept from 10 kHz to 60 kHz in 100 Hz increments while visually monitoring the oscillation amplitude for a distinct peak. The results are shown in FIG. 4B. The resonance frequencies for each bubble trapped within the HSS is defined by Equation I:

$$f_{mn} = \frac{1}{2}\sqrt{\frac{\sigma Z_a \pi}{\rho_2 (Z_l + Z_a)}}\left[\frac{m^2}{a^2} + \frac{n^2}{b^2}\right]^{\frac{3}{4}} \quad \text{(I)}$$

where $\sigma$ is the surface tension, $Z_l$ and $Z_a$, are the acoustic impedances, $\rho_l$, and $\rho_a$ are the densities of the fluids inside and outside of the HSS, respectively, a is the width of the HSS opening, and b is the height of the HSS. Excellent agreement (FIG. 4B) between the experimental results and theoretical values, for first mode m, n=1, indicates that the above equation can be used to design support structures for various applications using Equation I.

Figure 5A:
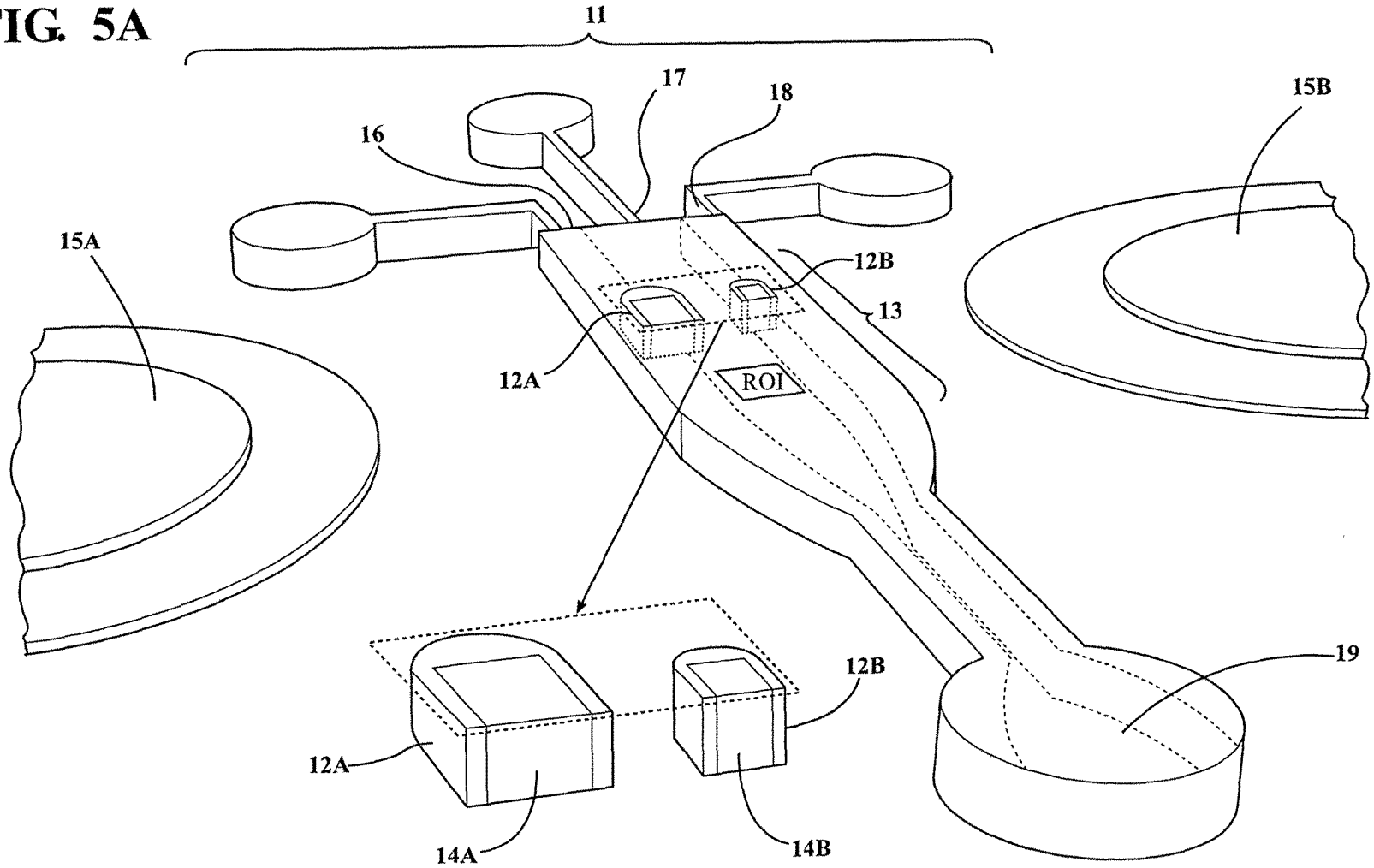
FIG. 5A is a schematic of an experimental setup for chemical switching using an apparatus according to one embodiment of the invention with the flow channel containing support structures of different sizes each in the form of a horseshoe structure (HSS), and subsequently bubbles of different sizes that are independently driven by transducers bonded to the substrate adjacent to the channel.
Figures 5B, 5C:
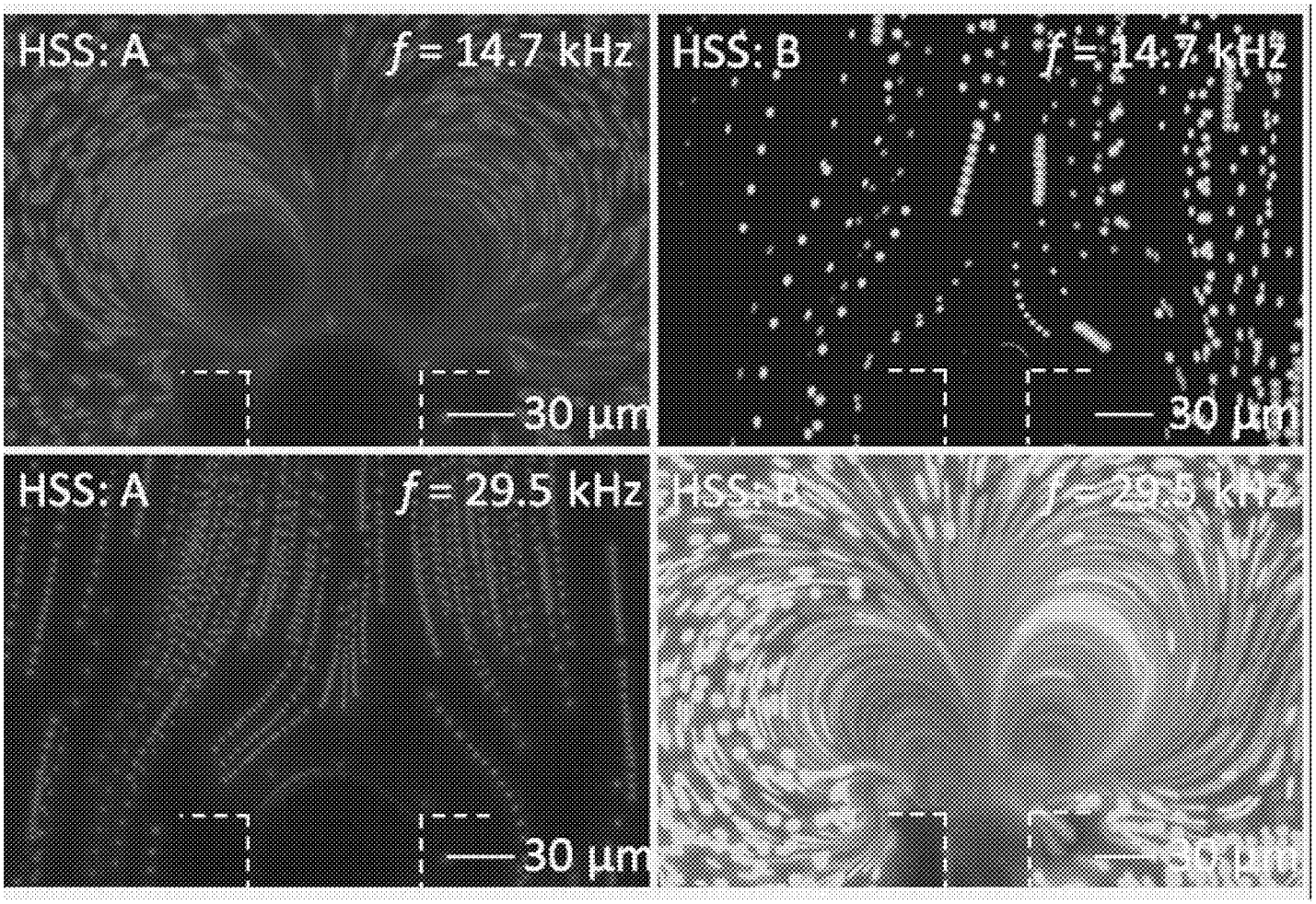
FIG. 5B is a visualization of microstreaming in the apparatus of FIG. 5A from the bubble trapped in HSS A, while no streaming is observed in the bubble trapped in HSS B at an excitation frequency of 14.7 kHz.
FIG. 5C is a visualization of the microstreaming in the apparatus of FIG. 5A from the bubble trapped in HSS B while no streaming occurs in HSS A at an excitation frequency of 29.5 kHz.

FIG. 5A is schematic diagram of another exemplary device according to a second embodiment of the invention used for switching between two different chemical signals. The channel 13 has three inlets 16, 17, and 18, and one outlet 19. Inlets 16 and 18 (peripheral regions) are infused with different chemical signals (e.g. red and blue dyes for demonstration), and inlet 17 pumped a buffer solution (water or buffer) into the central region that served as the ROI. Distinct support structures (110×165 μm 12A and 60×90 μm 12B) are positioned at each liquid-liquid interface. The corresponding bubbles had resonant frequencies of 29.5 kHz and 14.7 kHz. Cross-excitation of the bubbles at the above frequencies is negligible shown by the microstreaming bead test captured in FIGS. 5B and 5C. FIGS. 5B and 5C lay out the binary chemical circuitry: when bubble A is activated at f=14.7 kHz only the red dye mixed with the water to fill the region of interest (FIG. 5B, left panel). Conversely, when bubble B was activated at f=29.5 kHz, only the blue dye mixed with the water (FIG. 5C, right panel). Switching between the red and blue dyes was achieved by alternating between the two excitation frequencies as shown in FIG. 5F. The direct conversion of electrical signals into chemical waveforms allows this apparatus to access all of the previously demonstrated functions of the waveform generator including frequency and amplitude modulation.

In some embodiments, and apparatus is constructed of multiple support structures each containing an oscillating structure where the support structures are arranged in a ladder-like configuration. (FIG. 6A) In this setup the oscillating structures are oscillating in an acoustic field to provide a novel and versatile method to generate tunable, pulsatile chemical gradients in microdevices. In some embodiments, the bubbles are trapped and supported in polydimethylsiloxane (PDMS) microfluidic channels. Each oscillating bubble, when activated, mixes the stimulus and buffer solutions locally, effectively diluting the stimulant concentration. Subsequent transport of this mixed stimulant to the next bubble in the ladder results in further dilution of the stimulant thereby generating a spatial gradient of the stimulant across the microchannel. In addition, each of the oscillating bubbles can be activated or deactivated almost instantaneously using differing HSS size and multiple transducers, facilitating the generation of pulsatile chemical gradients. Furthermore, by controlling the mixing ratio of the stimulant and the buffer, the chemical gradient profiles can be tuned on-the-fly, allowing dynamic control of the chemical gradient profile.

Figure 6A:
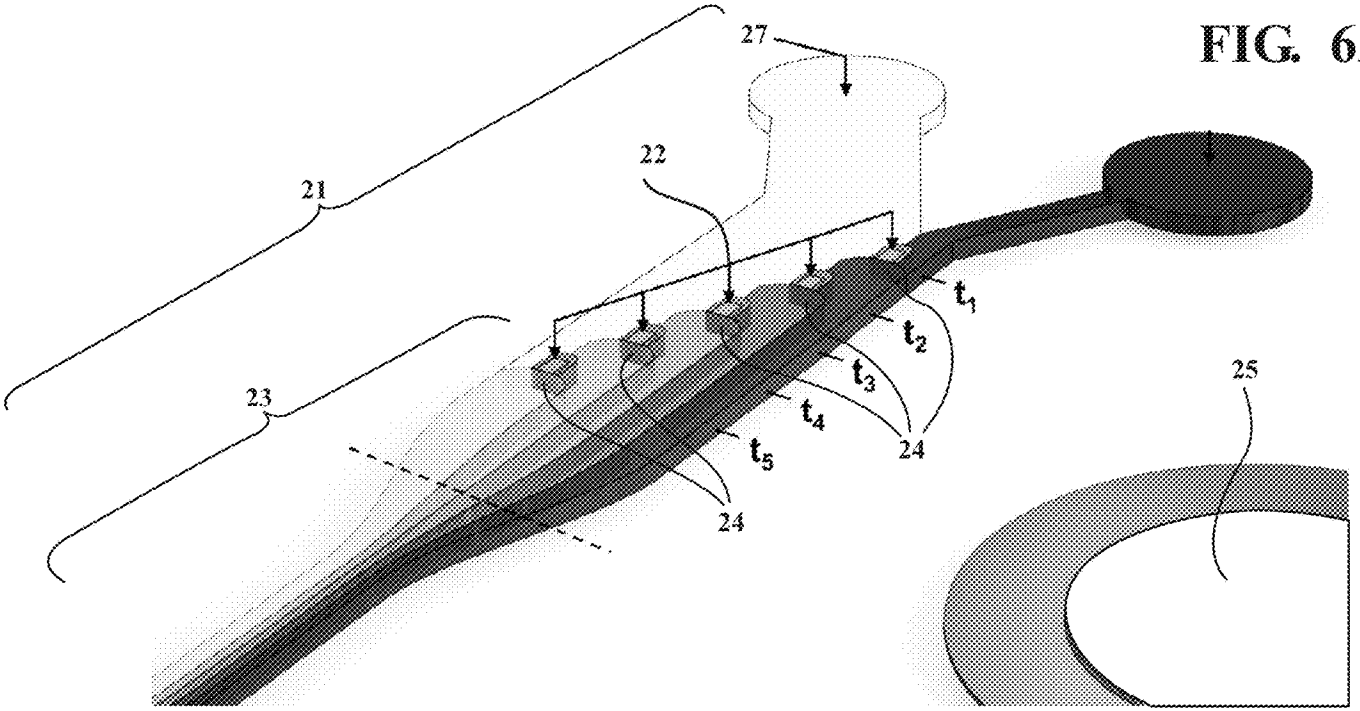
FIG. 6A is a schematic of tunable, pulsatile chemical gradient generation via acoustically driven oscillating bubbles in an apparatus according to one embodiment of the invention with the figure illustrating a piezoelectrical transducer placed adjacent to a microfluidic device on a substrate whereby a chemical gradient profile is established between the co-flowing stimulant (darker shade) and buffer (clear) in the microfluidic flow channel.
Figure 6B:
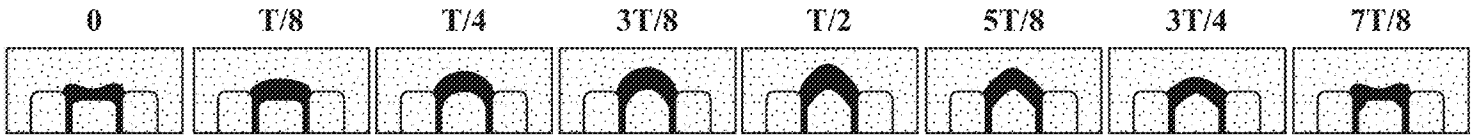
FIG. 6B is an image sequence acquired at 200,000 fps capturing one complete cycle of an oscillating bubble trapped within a horseshoe structure such as in the apparatus of FIG. 6A.

FIG. 6A illustrates an exemplary apparatus according to one embodiment of the invention in which multiple bubbles 14 are trapped by horseshoe structures 12 (e.g. 60×90×60 μm). A single-layer channel 23, optionally formed from PDMS, containing multiple horseshoe structures 22 is bonded to a glass slide, while a piezoelectric transducer 25 is attached adjacent to the channel 23. In an illustrative non-limiting example of operation, after the bubbles are trapped in the horseshoe structures, a stimulant at the maximum concentration of $C_0$ is introduced into the channel through the right inlet 28, while a buffer is infused through the left inlet 27. Parallel laminar flows of stimulant and buffer across the channel are established. When the bubbles are acoustically activated via the piezoelectric transducer at an excitation frequency (optionally 30 kHz), the oscillations of the bubbles exhibit the "microstreaming" phenomenon. In the non-limiting embodiment of FIG. 6A, all the horseshoe structures are designed to be of identical geometry. Under identical geometry conditions the trapped bubbles oscillate at a single resonance frequency. The acoustic microstreaming is generated due to the nonlinear effects of the oscillatory fluid motion produced by the acoustic waves. The pressure and velocity fluctuations in the liquid near the bubble cause rapid and homogeneous sideward mixing of the co-flowing liquids. As shown in FIG. 6A at $t_1$, the stimulant and buffer are mixed by the oscillating bubble nearest the inlets, resulting in a lower concentration, $C_1$, as the stimulant approaches the second bubble. At $t_2$, the liquid (after passing the first horseshoe structure) with concentration $C_1$ is mixed with the buffer in the laminar region resulting in further lower concentration $C_2$. As this step-wise dilution of the stimulant progresses, all the liquid is mixed and merged across the channel resulting in a spatial chemical gradient.

Figure 7A:
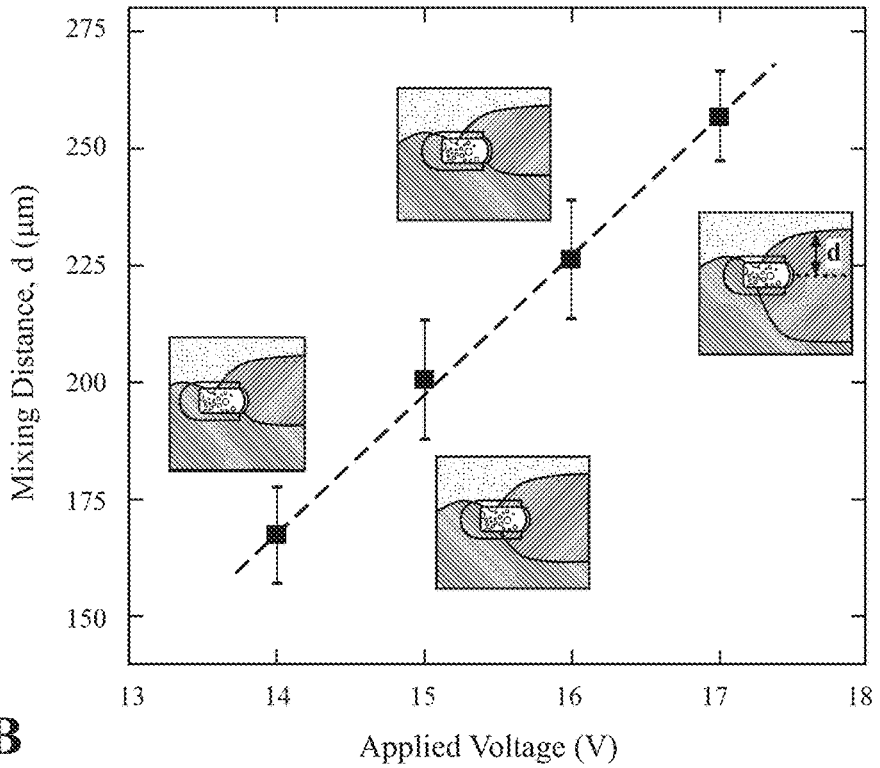
FIG. 7A depicts experimental results of mixing distance (d) as a function of applied voltage experimentally measured from the center of the support structure to the region where no mixing occurs)

Oscillation of bubbles can be tuned directly by controlling the voltage fed into the transducer. As indicated in the experimental results shown in FIG. 7A, the oscillation amplitude responds linearly to the applied voltage. As a consequence, the mixing distance, d, varies linearly with increasing applied voltage. Since bubbles trapped within the horseshoe structures are organized in a ladder-like formation with each one offsetting from the last one by a length, l, different applied voltages allow different mixing distances, enabling the production of different chemical profiles.

Figure 7B:
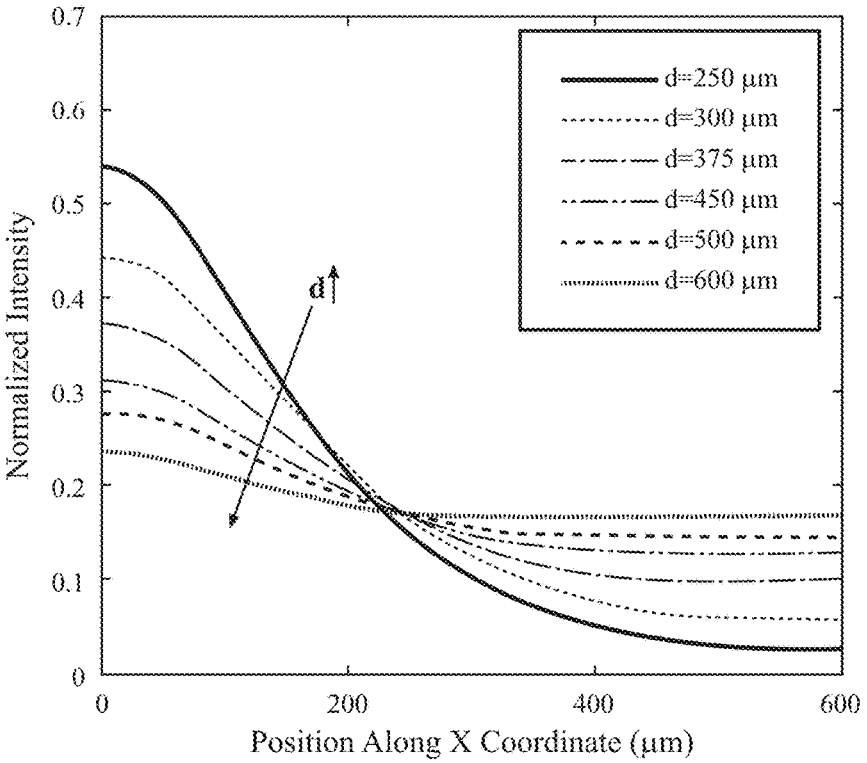
FIG. 7B illustrates simulated results showing the dynamic gradient profiles generated when the mixing distance is varied.
Figure 7C:
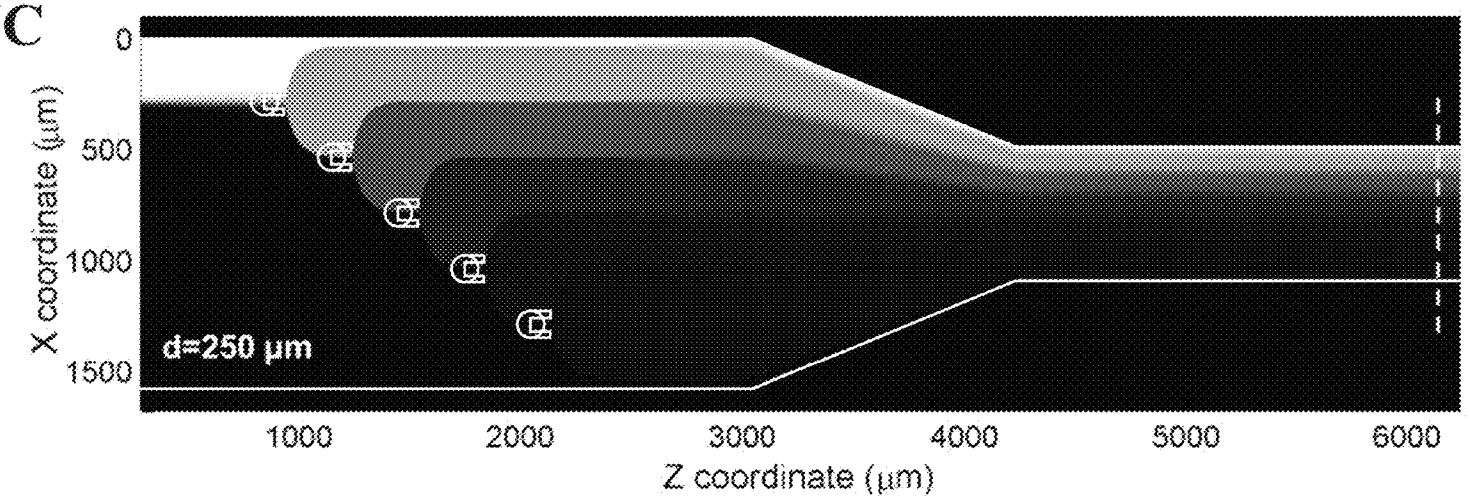
FIG. 7C are simulated results showing the generation of chemical gradients with a mixing distance of d=250 μm within the channel.
Figure 7D:
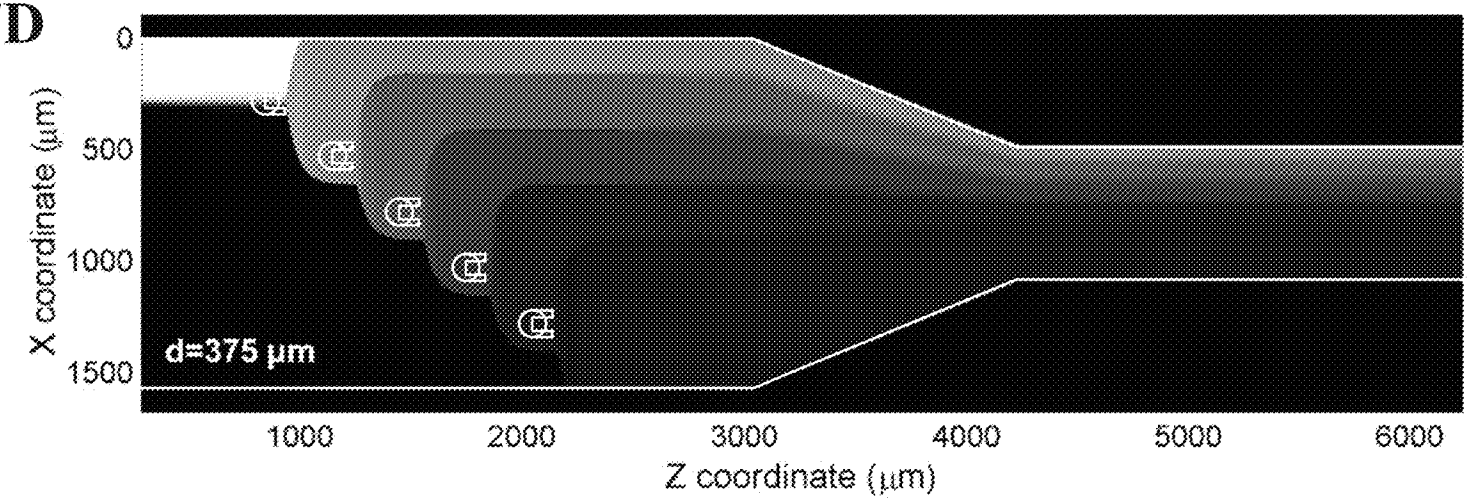
FIG. 7D are simulated results showing the generation of chemical gradients with a mixing distance of d=375 μm within the channel.

For a ladder-like horseshoe structure formation, and any other configuration, the generated gradient profiles may be simulated at different mixing distances using MATLAB code. The code considers both diffusion and bubble-enabled mixing effects. It also can be coded to make assumptions of homogeneous mixing, uniform flow velocity along X-coordinates, and the absence of crosstalk between bubbles. The simulated results for mixing distances of 250 μm and 375 μm are shown in FIGS. 7C and 7D, respectively. The simulated chemical gradient profiles measured downstream (noted by the dashed line in FIG. 7C) at mixing distances ranging from 250 μm to 600 μm are summarized in FIG. 7B. Clearly the relationship between the shape of generated gradient profile and the mixing distance is observed, which is controlled by the applied voltage. Therefore, by adjusting the applied voltage, the spatial and temporal chemical gradient profiles can be dynamically controlled.

Figures 8A, 8B:
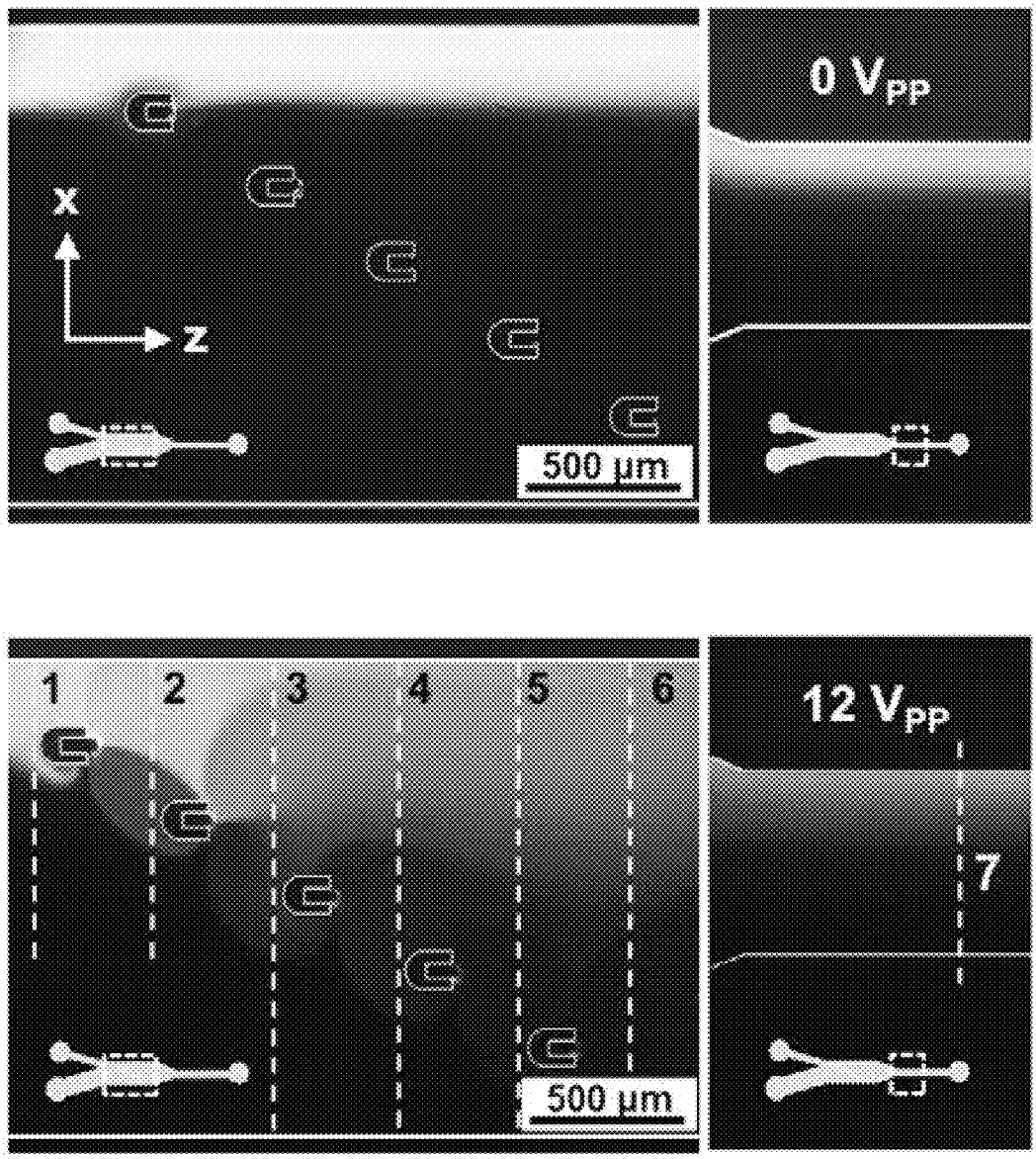
FIG. 8A is a characterization of concentration gradient profiles within the microfluidic flow channel of the apparatus of FIG. 6A illustrating the interface of FITC-dextran (dark shading) and PBS (light shading) at the first support structure, and the rear region when the piezoelectric transducer is turned off.
FIG. 8B is a characterization of concentration gradient profiles within the microfluidic flow channel of the apparatus of FIG. 6A at six different positions (1-6) analyzed across and along the channel during the on-state of the piezoelectric transducer at 12 $V_{pp}$ where each dotted-line was chosen at the rear end of the adjacent support structure.
Figure 8E:
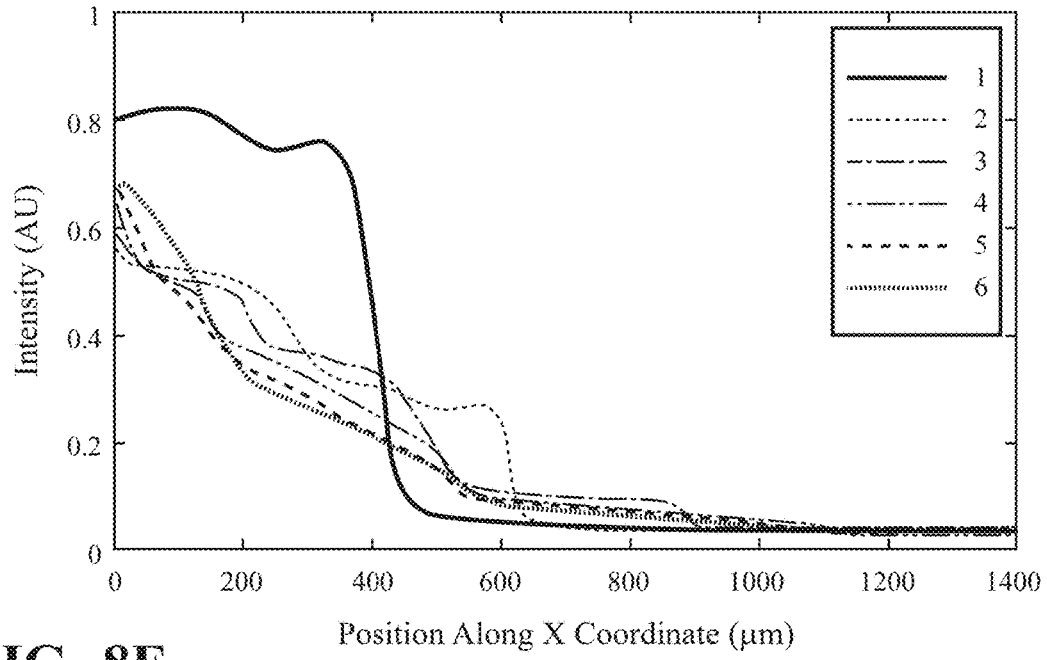
FIG. 8E illustrates the relative concentration with respect to input concentration (1 mg/ml) profiles for the corresponding positions in FIG. 8B measured by Image J and plotted to reveal the formation of concentration gradient profile where the change in concentration profile from position 1 to 6 of FIG. 8B was due to subsequent mixing and merging of co-flowing liquids around each of the bubble containing support structures.
Figure 8F:
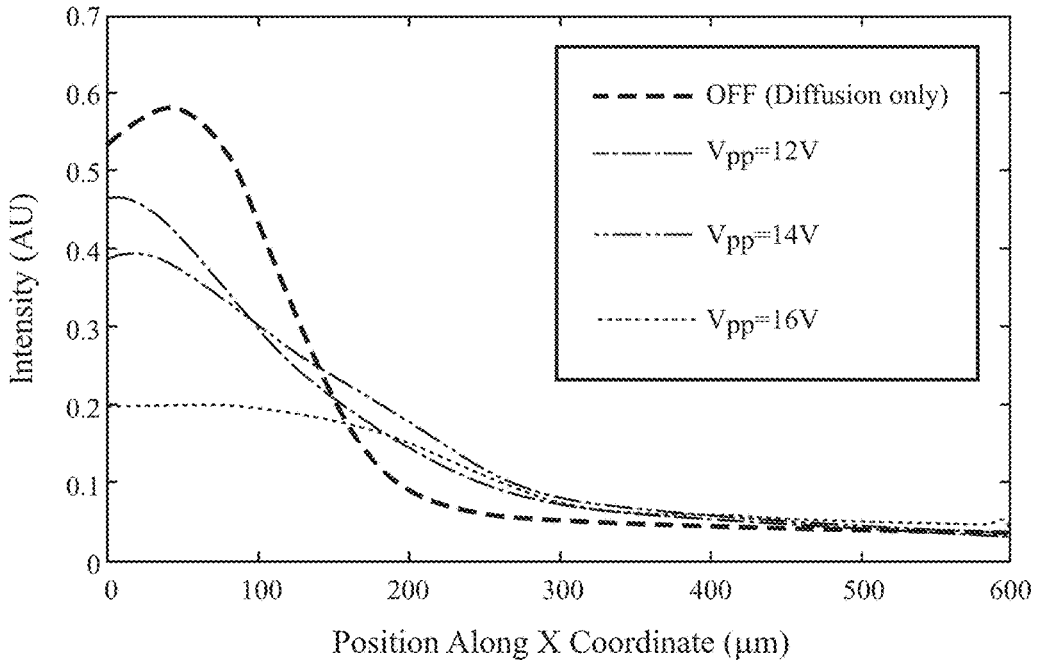
FIG. 8F is a graphical illustration showing different concentration gradient profiles at the rear end of the channel (position 7) in FIG. 8B, FIG. 8C, and FIG. 8D, respectively.

In one exemplary embodiment, dextran-FITC (stimulant) and phosphate buffered saline (buffer) solutions were used to generate different spatial and temporal concentration profiles across the microfluidic channel, and experimentally prove the effectiveness of the approach. Owing to the low Reynolds number in the microfluidic channel, laminar flow of the inflowing stimulant and buffer solutions was established during the "off" state of the transducer, as shown in FIG. 8A. Once the transducer was turned "on", all bubbles trapped within the horseshoe structures were excited simultaneously. The streaming and sideward mixing of the liquids at the trapped bubbles in a stepwise fashion resulted in a gradient of the stimulant. FIG. 8B shows the gradient generated around the horseshoe structures and the region far away from the bubbles. The voltage was adjusted such that a mixing ratio of 1:1 was achieved between subsequent bubbles, ensuring an exponential decay chemical profile. Fluorescence distribution across the channel at positions 1-6 (after passing each bubble, indicated in FIG. 8B) is shown in FIG. 8E. A step-like intensity function at position 1 was observed due to absence of mixing between the Dextran-FITC and PBS solution. At position 2, Dextran-FITC and PBS solutions were mixed in the region between the front end of the first horseshoe structure and the rear end of the second horseshoe structure. Similarly, the subsequent oscillating bubble progressively mixed and diluted the Dextran-FITC until an exponential decay gradient profile was established at position 6, as depicted in FIG. 8E. As the stimulant approaches the rear end of the channel, diffusion-induced mixing of the stimulant and buffer solutions results in smoothening of the generated chemical gradient, as shown in FIG. 8F ($V_{pp}$=12 V). The channel width may be decreased from 1.6 mm to 0.6 mm for additional apparatus studies under higher objectives. Overall, the measured intensity profiles fit well to a first-order exponential decay function, confirming that a 1:1 mixing ratio of the subsequent bubbles ensures an exponential gradient profile.

Different gradient profiles can be obtained by altering the mixing distance via changing the applied voltage from the function generator. FIGS. 8C and 8D show that different gradient profiles are generated at 14 $V_{pp}$ and 16 $V_{pp}$, respectively. The corresponding intensity profiles are shown in FIG. 8F. When the applied voltage varied from 12 $V_{pp}$ to 14 $V_{pp}$, the mixing distance changed accordingly giving rise to a steeper gradient profile. Similarly, as the applied voltage is increased to 16 $V_{pp}$, the stronger acoustic streaming results in even higher mixing distance (FIG. 8D). Therefore, the obtained gradient profile is gradual and tended to be sigmoidal like under these specific conditions. These results show that the apparatus has excellent flexibility in tuning chemical profiles.

Besides the capability to produce different gradient profiles, example apparatuses and methods are also capable of generating pulsatile gradients at frequencies as high as 0.1 Hz and in some examples, higher frequencies such as 1 Hz or greater (e.g. 0.1-100 Hz). The excitation frequency of the bubble may be higher than the frequency of the chemical gradient modulation. For example, the bubbles are optionally excited at in a frequency range 10 Hz-1 MHz, optionally 1 kHz-100 kHz, optionally around 10 kHz-50 kHz, optionally approximately or at 30 kHz. In some examples, range limits may be approximate.

Figure 9:
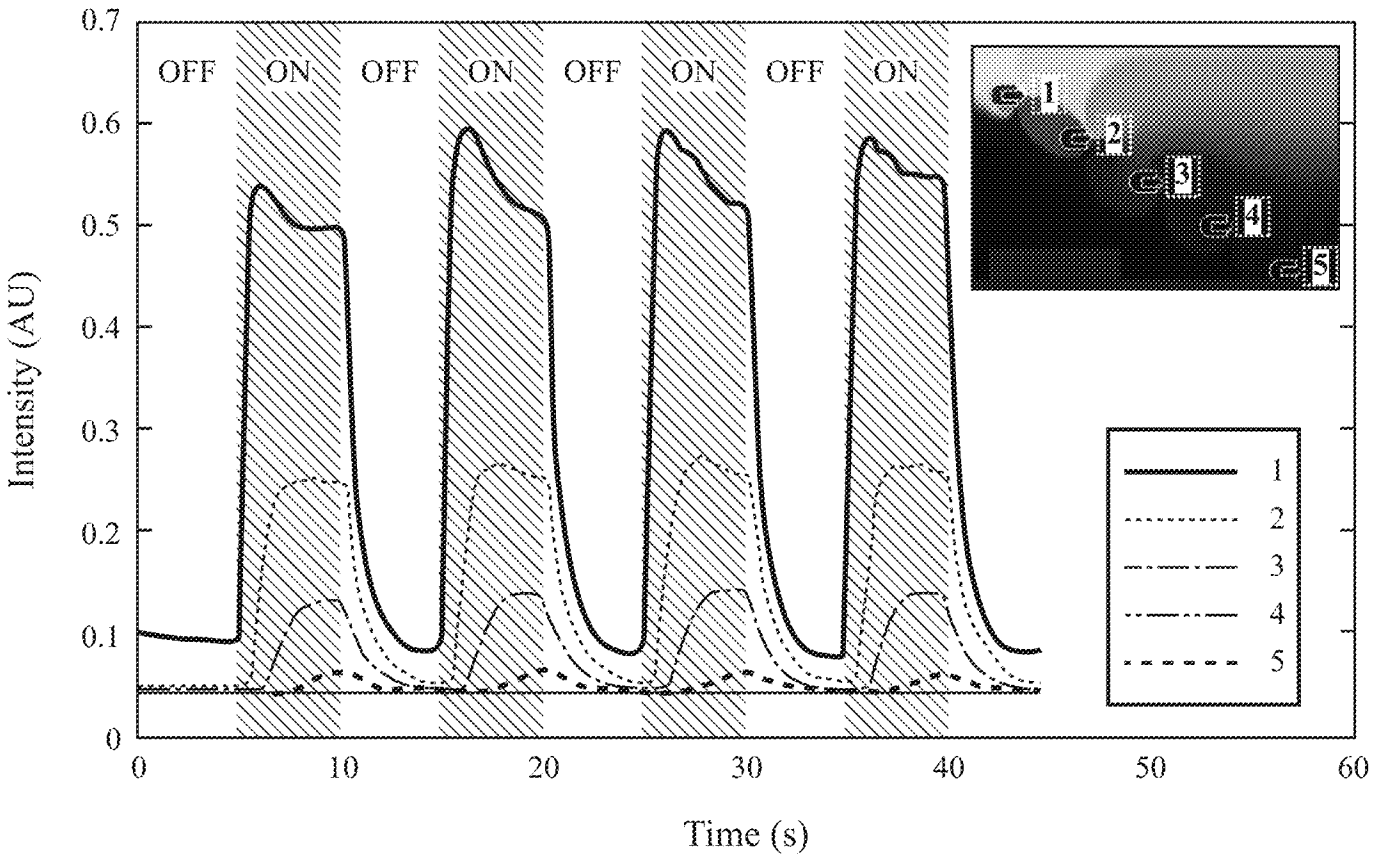
FIG. 9 shows experimental results for the pulsing of the gradient at different positions across the flow channel of the apparatus of FIG. 6A at a frequency of 0.1 Hz with fluorescent intensities measured and analyzed at positions 1-5 (see inset) during the on and off state of the transducer.

FIG. 9 illustrates the fluorescent intensity profiles at positions 1-5 or the exemplary apparatus of FIG. 6A (see inset) at different time values when a pulsing signal from the function generator is used to trigger the formation of the gradient. Evidently, pulsing gradient profiles can be generated far away from the acoustic streaming region, thereby removing any shear stress developed by the oscillating bubble.

Applications of the apparatus include microfluidic devices (as used here, this term includes nanofluidic devices), for chemical, biological (including molecular biology, cell migration, cytotoxicity), and biochemical (including enzyme, protein, DNA, RNA, proteomics, pathology, and the like) analysis, assay, detection, modification, interaction, preparation, treatment, or characterization applications. Applications also include a fluid mixing apparatus for any application, including chemical formulations, inkjet apparatus, chemical deposition, film formation, and the like, optofluidic devices (e.g. to obtain gradient refractive indices, for example for lens arrays), and the like. Specific applications include nanofluidic devices, chemical probing of cells, and programmable chemical waveform generation and switching using acoustically activated bubbles. Examples include apparatuses and methods for generating chemical concentration or physical (e.g. electrical and/or optical property) gradients that may be dynamically controlled by an electronic circuit, e.g. one providing a variable drive signal to a piezoelectric transducer.

Fluid flows are optionally liquids, suspensions, and the like. Flows may include suspended particles, such as biological structures illustratively including, but not limited to cells, platelets, or proteins, among others. Bubbles are optionally air-filled, or the flow channel filled with another gas before introduction of the fluid flows, allowing other gas bubbles to be used. In some examples, microspheres, micelles, particles, and the like may be used to obtain oscillation-induced mixing. Applications include characterization of particles such as cells, including cell chemotaxis, cell differentiation, and cell migration studies in a dynamic chemical environment.

Hence, spatial and temporal chemical gradient profiles are achieved using one or more acoustically driven oscillating bubbles located within a flow channel, for example using a single bubble located within the flow channel, or a plurality of bubbles, for example positioned in a ladder-like formation using bubble support structures within the flow channel. Changing the applied voltage of a drive signal applied to an acoustic transducer such as a piezoelectric transducer dynamically tunes the generated chemical gradient profiles, both spatially and temporally. More complex and abundant chemical profiles through changing location(s) of the bubble supports, for example, may be made. The design of the ladder-like formation may be modified using different configurations of the bubble support structures within the flow channel. Chemical gradients may be adjusted using flow rate control of inlet fluid flows in combination with drive signal modification.

Acoustofluidic-based methods and apparatus for generating chemical gradient can be used in many chemical and biological studies and applications, such as apparatuses and methods for investigating cell chemotaxis, differentiation, and migration in a dynamic chemical environment.

Using the on-chip waveform generator and switch such as in many embodiments of the inventive apparatus, it is possible to measure the dynamics of receptor-mediated signaling and other cellular responses to small molecules. The device can also be used to study cellular processes that span a wide range of time scales, from milliseconds to hours. Generating waveforms in continuous flow also eliminates the abrupt changes in shear stress at the cell membrane in segmented flow devices, more closely mimicking the in-vivo chemical signals. These precisely controlled chemical waveforms can be used for measuring the kinetics of fast enzymatic reactions, explaining the specificity and efficiency of gene expression, and developing time-release drugs, among other applications. Chemical waveforms may have markedly different effects on cellular signaling pathways that receive, transmit, process, and implement directions from chemical stimuli, compared with constant signals, and arbitrary chemical waveforms can be determined.

Examples of the present invention further include apparatuses and methods for generating tunable, pulsatile chemical gradient generation via acoustically driven oscillating bubbles.

A novel concept of generating both static and pulsatile chemical gradients using acoustically activated bubbles was developed, in some examples using a ladder-like arrangement. These results show that the chemical gradient profiles can be effectively tuned by regulating the amplitude of the bubble oscillation.

Pulsatile chemical gradients generated in microfluidic devices may be used for the characterization of dynamic biological and chemical processes. Spatial and temporal characteristics of chemical stimuli play an important role in cell signaling, and hence this may be investigated using described approaches.

Pulsatile chemical gradients may also be used in improved apparatus and methods for high-throughput characterization of cellular processes such as directed migration, differentiation, and apoptosis. Apparatus and methods according to examples of the present invention allow dynamic temporal control of chemical gradients to be achieved.

REFERENCE LIST

1. Shimizu T S, Tu Y, Berg H C (2010) A modular gradient-sensing network for chemotaxis in *Escherichia coli* revealed by responses to time-varying stimuli. *Molecular Systems Biology* 6: 382.
2. Lipan O, Wong W H (2005) The use of oscillatory signals in the study of genetic networks. *Proc. Natl. Acad. Sci. USA* 102: 7063-8.
3. Kholodenko B N, Hancock J F, Kolch W (2010) Signalling ballet in space and time. *Nature Rev. Mol. Cell. Biol.* 11: 414-426.
4. Yosef N, Regev A (2011) Impulse Control: Temporal dynamics in gene transcription *Cell* 144: 886-896.
5. Dolmetsch R E, Xu K, Lewis R S (1998) Calcium oscillations increase the efficiency and specificity of gene expression. *Nature* 392: 933-936.
6. Ashall L et al. (2009) Pulsatile Stimulation Determines Timing and Specificity of NF-kB—Dependent Transcription. *Science* 324: 242-246.
7. Werner S L, Barken D, Hoffmann A (2005) Stimulus specificity of gene expression programs determined by temporal control of IKK activity. *Science* 309: 1857-61.
8. Basu S, Mehreja R, Thiberge S, Chen M, Weiss R (2004) Spatiotemporal control of gene expression with pulse-generating networks. *Proc. Natl Acad. Sci. USA* 101: 6355-6360.
9. Takahashi K, Tanase-Nicola S, Wolde P R (2010) Spatio-temporal correlations can drastically change the response of MAPK pathway. *Proc. Natl. Acad. Sci. USA* 107: 2473-2478.
10. Li Jeon N et al. (2002) Neutrophil chemotaxis in linear and complex gradients of interleukin-8 formed in a microfabricated device. *Nature Biotechnology* 20: 826-30.
11. Ghafar-zadeh E, Waldeisen R, Lee L P (2011) Engineered approaches to the stem cell microenvironment for cardiac tissue regeneration. *Lab chip* 11: 3031-3048.
12. Wlodkowic D, Skommer J, Faley S, Darzynkiewicz Z, Cooper J M (2009) Dynamic analysis of apoptosis using cyanine SYTO probes: from classical to microfluidic cytometry. *Experimental Cell Research* 315: 1706-14.

13. Hersen P, McClean M N, Mahadevan L, Ramanathan S (2008) Signal processing by the HOG MAP kinase pathway. *Proc. Natl. Acad. Sci. USA* 105: 7165-7070.
14. Irimia D (2010) Microfluidic technologies for temporal perturbations of chemotaxis. *Annu. Rev. Biomed. Eng.* 12: 259-84. 13
15. Meier B et al. (2011) Chemotactic cell trapping in controlled alternating gradient fields. *Proc. Natl Acad. Sci. USA* 108: 11417-11422.
16. Yang Y et al. (2012) Optofluidic waveguide as a transformation optics device for lightwave bending and manipulation, *Nature Commun.* 3: 651.
17. Irimia D, Geba D A, Toner M (2006) Universal microfluidic gradient generator. *Anal. Chem.* 78: 3472-7.
18. Berthier E, Surfus J, Verbsky J, Beebe D (2010) An arrayed high-content chemotaxis assay for patient diagnosis. *Integr. Biol.* 2: 630-638.
19. Qasaimeh M A et al. (2011) Microfluidic quadrupole and floating concentration gradient. *Nature Commun.* 2: 464.
20. Goulpeau J, Lonetti B, Trouchet D, Ajdari A, Tabeling P (2007) Building up longitudinal concentration gradients in shallow microchannels. *Lab Chip* 7: 1154-1161.
21. Bae A J, Beta C, Bodenschatz E (2009) Rapid switching of chemical signals in microfluidics devices. *Lab Chip* 9: 3059-3065.
22. Eriksson E et al. (2010) A microfluidic device for reversible environmental changes around single cells using optical tweezers for cell selection and positioning. *Lab Chip* 10: 617-625.
23. Olofsson J et al. (2005) A chemical waveform synthesizer. *Proc. Natl. Acad. Sci. USA* 102: 8097-102.
24. Kress H et al. (2009) Cell stimulation with optically manipulated microsources. *Nature Meth.* 6: 905-9.
25. King K R, Wang S, Jayaraman A, Yarmush M L, Toner M (2008) Microfluidic flow-encoded switching for parallel control of dynamic cellular microenvironments. *Lab Chip* 8: 107-16.
26. Amarie D, Glazier J A, Jacobson S C (2007) Compact microfluidic structures for generating spatial and temporal gradients. *Anal. Chem.* 79: 9471-7.
27. Leslie D C et al. (2009) Frequency-specific flow control in microfluidic circuits with passive elastomeric features. *Nature Phys.* 5: 231-235.
28. Irimia D et al. (2006) Microfluidic system for measuring neutrophil migratory responses to fast switches of chemical gradients. *Lab Chip* 6: 191-8. 14
29. Mosadegh B et al. (2010) Integrated elastomeric components for autonomous regulation of sequential and oscillatory flow switching in microfluidic devices. *Nature Phys.* 6: 433-437.
30. Kuczenski B, Ruder W C, Messner W C, Leduc P R (2009) Probing cellular dynamics with a chemical signal generator. *PloS One* 4: e4847.
31. Unger M A, Chou H, Thorsen T, Scherer A, Quake S R (2000) Monolithic Microfabricated Valves and Pumps by Multilayer Soft Lithography. *Science* 288: 113-116.
32. Marmottant P, Hilgenfeldt S A (2004) A bubble-driven microfluidic transport element for bioengineering. *Proc. Natl Acad. Sci. USA* 101: 9523-7.
33. Wiklund M, Gunther C, Lemor R, Jager M, Fuhr G, Hertz H M (2006) Ultrasonic standing wave manipulation technology integrated into a dielectrophoretic chip. *Lab Chip* 6: 1537-1544.
34. Le Gac S, van den Berg A (2010) Single cells as experimentation units in lab-on-a-chip devices. *Trends in Biotechnology* 28: 55-62.
35. Ahmed D, Mao X, Shi J, Juluri B K, Huang T J (2009) A millisecond micromixer via single-bubble-based acoustic streaming. *Lab Chip* 9, 2738-41.
36. Patel M V, Tovar A R, Lee A T (2011) Lateral cavity acoustic transducer as an on-chip cell/particle microfluidic switch. *Lab Chip* 12: 139-45.
37. Dykes J, Lenshof A, Åstrand-Grundström I-B, Laurell T, Scheding S (2011) Efficient removal of platelets from peripheral blood progenitor cell products using a novel micro-chip based acoustophoretic platform. *PloS One* 6: e23074.
38. Petersson F, Nilsson A, Holm C, Jonsson H, Laurell T (2005) Continuous separation of lipid particles from erythrocytes by means of laminar flow and acoustic standing wave forces. *Lab Chip* 5: 20-22
39. Langelier S M, Chang D S, Zeitoun R I, Burns M A (2009) Acoustically driven programmable liquid motion using resonance cavities. *Proc. Natl. Acad. Sci. USA* 106: 12617-22.
40. Tovar A R, Lee, A P (2009) Lateral cavity acoustic transducer. *Lab Chip* 9: 41-3.
41. Tho P, Manasseh R, Ooi A (2007) Cavitation microstreaming patterns in single and multiple bubble systems. *J. Fluid. Mech.* 576: 191-233.
42. Leighton T G (1994) *The Acoustic Bubble*. (Academic Press: London). 15
43. Frommelt T et al. (2008) Microfluidic mixing via acoustically driven chaotic advection. *Phys. Rev. Lett.* 100: 034502-1.
44. Franke T, Abate A R, Weitz D A, Wixforth A, (2009) Surface acoustic wave (SAW) directed droplet flow in microfluidics for PDMS devices. *Lab Chip* 9: 2625-7.
45. Song H, Ismagilov R F (2003) Millisecond kinetics on a microfluidic chip using nanoliters of reagents. *J. Am. Chem. Soc.* 125: 14613-9.
46. Salmon J-B et al. (2005) An approach to extract rate constants from reaction—diffusion dynamics in a microchannel. *Anal. Chem.* 77: 3417-24.
47. Dittrich P S, Manz A (2006) Lab-on-a-chip: microfluidics in drug discovery. *Nature* 5: 210-218.
48. Abate A R, Hung T, Mary P, Agresti J J, Weitz D A (2010) High-throughput injection with microfluidics using picoinjectors. *Proc. Natl Acad. Sci. USA* 107: 19163-19166.
49. Diez S, Gerisch G, Anderson K, Muller-Taubenberger A, Bretschneider T (2005) Subsecond reorganization of the actin network in cell motility and chemotaxis. *Proc. Natl. Acad. Sci. USA* 102: 7601-7606.
50. Pierres A et al. (2007) Dissecting subsecond cadherin bound states reveals an efficient way for cells to achieve ultrafast probing of their environment. *FEBS Letters* 581: 1841-1846.
51. Shamri R et al. (2005) Lymphocyte arrest requires instantaneous induction of an extended LFA-1 conformation mediated by endothelium-bound chemokines. *Nature Immunol.* 6: 497-506.

Patents or publications mentioned in this specification are herein incorporated by reference to the same extent as if each individual publication was specifically and individually indicated to be incorporated by reference.

The invention is not restricted to the illustrative examples described herein. Examples described are exemplary, and are not intended to limit the scope of the invention. Changes therein, other combinations of elements, and other uses will occur to those skilled in the art.

Having described our invention, we claim:

1. An apparatus for generating a chemical gradient in a fluid flow, the apparatus comprising:

a flow channel, the flow channel having a first inlet configured to introduce a first fluid flow into the flow channel, and a second inlet configured to introduce a second fluid flow into the flow channel, the flow channel also comprising an outlet;

the flow channel having a wall configured to contact the first fluid or the second fluid;

a support structure located within the flow channel and extending into the flow channel from the wall and configured such that the first fluid and the second fluid may contact the support structure and the wall, the support structure including an opening in a downstream portion of the support structure, the support structure supporting an oscillating structure within the flow channel when the first and second flows are introduced into the flow channel; and an oscillatory energy field generator operable to produce oscillation in said oscillating structure, wherein excitation of said oscillating structure induces m1×mg of said first and said second fluid flows, the apparatus generating a chemical gradient having a time-dependence controllable using the oscillatory energy field generator.

2. The apparatus of claim 1, the support structure including a curved wall.

3. The apparatus of claim 2, the opening in the curved wall of the support structure facing the outlet of the flow channel.

4. The apparatus of claim 2, the support structure having a C-shape, a U-shape, or a horseshoe shape.

5. The apparatus of claim 1, the flow channel being a microchannel, the microchannel being supported by a substrate and being defined by the substrate and walls formed in a molded polymer, the microchannel having a width parallel to the substrate and a height normal to the substrate, the width, height, or both being less than 1 mm.

6. The apparatus of claim 1, the flow channel having a height and a width, the width or the height or both being less than 1 mm.

7. The apparatus of claim 1, the oscillatory energy field generator being a piezoelectric transducer.

8. The apparatus of claim 1, the chemical gradient having a time-dependence controllable using a drive signal applied to the oscillatory energy field generator, or by modifying a flow rate of the first or second flow.

9. An apparatus for generating a chemical gradient in a fluid flow, the apparatus comprising:

a flow channel, the flow channel being a microchannel configured to channel a liquid flow therethrough;

a first inlet configured to introduce a first liquid into the flow channel;

a second inlet configured to introduce a second liquid into the flow channel;

a flow channel outlet;

the flow channel having a wall configured to contact the first liquid or the second liquid;

a bubble support structure located within the flow channel and extending into the flow channel from the wall and configured such that the first fluid and the second fluid may contact the support structure and the wall, the bubble support structure including an opening in a downstream portion of the bubble support structure, the bubble support structure configured to support a bubble within the flow channel when the liquid flow passes through the flow channel; and an acoustic transducer located proximate the flow channel, the acoustic transducer oriented to be operable to generate oscillations in the bubble using acoustic waves, the oscillations of the bubble capable of generating the chemical gradient in the liquid flow.

10. The apparatus of claim 9, the chemical gradient being in a transverse direction to the liquid flow.

11. The apparatus of claim 9, further including an electronic circuit for driving the acoustic transducer, the electronic circuit providing a drive signal to the acoustic transducer, the chemical gradient having a time-dependence controllable using the drive signal.

12. The apparatus of claim 9, including a plurality of bubble support structures located within the flow channel.

13. A method of generating a chemical gradient in a flow channel of claim 1, the method including:

introducing a first fluid and a second fluid into the flow channel, supporting a bubble within the channel; and generating acoustic waves to drive oscillations in the bubble, the oscillations inducing a mixing between the first fluid and the second fluid, the chemical gradient being formed by said mixing.

14. The method of claim 13, the first fluid being a first liquid, the second fluid being a second liquid, the channel being a flow channel, the first liquid and the second liquid passing through the flow channel, the oscillations of the bubble within the flow channel creating the chemical gradient due to different chemical compositions of the first and second liquids.

15. The method of claim 13, the channel being a microfluidic channel.

16. The method of claim 13, wherein said generating acoustic waves comprises driving a piezoelectric transducer using a drive signal, said piezoelectric transducer being located proximate the flow channel and generating the acoustic waves.

17. The method of claim 16, further including dynamically controlling the chemical gradient using said drive signal.

18. The method of claim 13, further including controlling the chemical gradient using a flow rate of the first or second fluids.

19. The apparatus of claim 1, the support structure oriented to allow fluid flow on at least two opposing sides in a direction perpendicular to the flow of the fluid.

20. The apparatus of claim 9, the support structure oriented to allow fluid flow on at least two opposing sides in a direction perpendicular to the flow of the fluid.

* * * * *